US008290783B2

(12) United States Patent
Schnell et al.

(10) Patent No.: US 8,290,783 B2
(45) Date of Patent: Oct. 16, 2012

(54) APPARATUS FOR MIXING A PLURALITY OF INPUT DATA STREAMS

(75) Inventors: Markus Schnell, Erlangen (DE); Manfred Lutzky, Nuremberg (DE); Markus Multrus, Nuremberg (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 859 days.

(21) Appl. No.: 12/398,026

(22) Filed: Mar. 4, 2009

(65) Prior Publication Data

US 2009/0228285 A1 Sep. 10, 2009

Related U.S. Application Data

(60) Provisional application No. 61/033,590, filed on Mar. 4, 2008.

(51) Int. Cl.
*G10L 19/00* (2006.01)
*G10L 19/14* (2006.01)

(52) U.S. Cl. ..... 704/500; 704/200.1; 704/205

(58) Field of Classification Search ..... None
See application file for complete search history.

(56) References Cited

U.S. PATENT DOCUMENTS

| | | | | |
|---|---|---|---|---|
| 5,463,424 | A | 10/1995 | Dressler | |
| 7,519,538 | B2 * | 4/2009 | Villemoes et al. | 704/501 |
| 7,668,722 | B2 * | 2/2010 | Villemoes et al. | 704/500 |
| 8,036,903 | B2 * | 10/2011 | Grill et al. | 704/500 |
| 2005/0102137 | A1 | 5/2005 | Zinser et al. | |
| 2006/0173691 | A1 | 8/2006 | Mukaide | |
| 2007/0112559 | A1 * | 5/2007 | Schuijers et al. | 704/203 |
| 2008/0097764 | A1 | 4/2008 | Grill et al. | |

(Continued)

FOREIGN PATENT DOCUMENTS

| | | |
|---|---|---|
| EP | 1377123 | 1/2004 |

(Continued)

OTHER PUBLICATIONS

Albert, Tobias; Ekstrand, Per; Geiger, Ralf; Henn, Fredrik; Lutzky, Manfred; Przioda, Daniel; Ruoppila, Vesa; Schmidt, Markus; Schnell, Markus; Tames, Erlend, "Delayless Mixing—On the Benefits of MPEG-4 AAC-ELD in High Quality Communication Systems," AES Convention:124 (May 2008).*

(Continued)

*Primary Examiner* — Matthew Sked
(74) *Attorney, Agent, or Firm* — Glenn Patent Group; Michael A. Glenn

(57) ABSTRACT

An apparatus according to an embodiment of the present invention for mixing a first frame of a first input data stream and a second frame of a second input data stream has a processing unit adapted to generate an output frame, wherein the output frame has output spectral data describing a lower part of an output spectrum up to an output cross-over frequency, and wherein the output frame further has output SBR-data describing a higher part of the output spectrum above the output cross-over frequency by way of energy-related values in an output time/frequency grid resolution. The processing unit is further adapted such that the output spectral data corresponding to frequencies below a minimum value of cross-over frequencies of the first frame, the second frame and the output cross-over frequency is generated in a spectral domain and the output SBR-data corresponding to frequencies above a maximum value of cross-over frequencies of the first and second frames and the output cross-over frequency is processed in a SBR-domain.

16 Claims, 12 Drawing Sheets

U.S. PATENT DOCUMENTS

2008/0219473 A1* 9/2008 Sugiyama et al. ..... 381/94.4

FOREIGN PATENT DOCUMENTS

| | | |
|---|---|---|
| EP | 1713061 | 10/2006 |
| WO | 2005/078707 | 8/2005 |

OTHER PUBLICATIONS

Yeongha Choi et al.: "A new digital surround processing system for general A/V sources" IEEE transactions on consumer electronics, IEEE Service Center, New York, NY, US, vol. 41, No. 4 Nov. 1, 1995, pp. 1174-1180, XP000553496 ISSN: 0098-3063, paragraph (000B)-paragraph (000C); figure 3.

International Search Report for parallel application PCT/EP2009/001534, ISR mailed on Feb. 9, 2010, 17 pages.

Tobias Friedrich, et al, "Spectral Band Replication Tool for very low delay Audio Coding Applications", IEEE Workshop on Applicaions of Signal Processing to Audio and Acoustics, Oct. 21, 24,New Platz, NY, pp. 199 to 202, 2007.

Per Ekstrand, "Bandwidth Extension of Audio Signals by Spectral Band Replication", IEEE Benelux Workshop of Model based Processing and Coding of Audio (MPCA-2002), Leuven Belgium, Nov. 15, 2002, pp. 53 to 58.

Technical Specification "Universal Mobile Telecommunication Systems (UTMS), . . . " ETSI TS 126 404, Sep. 2004.

* cited by examiner

APPARATUS FOR MIXING A PLURALITY OF INPUT DATA STREAMS

CROSS-REFERENCE TO RELATED APPLICATIONS

This application claims priority from U.S. Patent Application No. 61/033,590, which was filed on Mar. 4, 2008, and is incorporated herein in its entirety by reference.

BACKGROUND OF THE INVENTION

Embodiments according to the present invention relate to apparatuses for mixing a plurality of input data streams to obtain an output data stream, which may for instance be used in the field of conferencing systems including video conferencing systems and teleconferencing systems.

In many applications more than one audio signal is to be processed in such a way that from the number of audio signals, one signal, or at least a reduced number of signals is to be generated, which is often referred to as "mixing". The process of mixing of audio signals, hence, may be referred to as bundling several individual audio signals into a resulting signal. This process is used for instance when creating pieces of music for a compact disc ("dubbing"). In this case, different audio signals of different instruments along with one or more audio signals comprising vocal performances (singing) are typically mixed into a song.

Further fields of application, in which mixing plays an important role, are video conferencing systems and teleconferencing systems. Such a system is typically capable of connecting several spatially distributed participants in a conference by employing a central server, which appropriately mixes the incoming video and audio data of the registered participants and sends to each of the participants a resulting signal in return. This resulting signal or output signal comprises the audio signals of all the other conference participants.

In modern digital conferencing systems a number of partially contradicting goals and aspects compete with each other. The quality of a reconstructed audio signal, as well as applicability and usefulness of some coding and decoding techniques for different types of audio signals (e.g. speech signals compared to general audio signals and musical signals), have to be taken into consideration. Further aspects that may have to be considered also when designing and implementing conferencing systems are the available bandwidth and delay issues.

For instance, when balancing quality on the one hand and bandwidth on the other hand, a compromise is in most cases inevitable. However, improvements concerning the quality may be achieved by implementing modern coding and decoding techniques such as the AAC-ELD technique (AAC=Advanced Audio Codec; ELD=Enhanced Low Delay). However, the achievable quality may be negatively affected in systems employing such modern techniques by more fundamental problems and aspects.

To name just one challenge to be met, all digital signal transmissions face the problem of an essential quantization, which may, at least in principle, be avoidable under ideal circumstances in a noiseless analog system. Due to the quantization process inevitably a certain amount of quantization noise is introduced into the signal to be processed. To counteract possible and audible distortions, one might be tempted to increase the number of quantization levels and, hence, increase the quantization resolution accordingly. This, however, leads to a greater number of signal values to be transmitted and, hence, to an increase of the amount of data to be transmitted. In other words, improving the quality by reducing possible distortions introduced by quantization noise might under certain circumstances increase the amount of data to be transmitted and may eventually violate bandwidth restrictions imposed on a transmission system.

In the case of conferencing systems, the challenges of improving a trade-off between quality, available bandwidth and other parameters may be even further complicated by the fact that typically more than one input audio signal is to be processed. Hence, boundary conditions imposed by more than one audio signal may have to be taken into consideration when generating the output signal or resulting signal produced by the conferencing system.

Especially in view of the additional challenge of implementing conferencing systems with a sufficiently low delay to enable a direct communication between the participants of a conference without introducing substantial delays which may be considered unacceptable by the participants, further increases the challenge.

In low delay implementations of conferencing systems, sources of delay are typically restricted in terms of their number, which on the other hand might lead to the challenge of processing the data outside the time-domain, in which mixing of the audio signals may be achieved by superimposing or adding the respective signals.

For improving the trade-off between quality and bitrate in the case of general audio signals, a significant number of techniques exist which are capable of further improving a trade-off between such contradicting parameters such as quality of a reconstructed signal, bitrate, delay, computational complexity and further parameters.

A highly flexible tool to improve the previously mentioned trade-off is the so-called spectral band representation tool (SBR). The SBR-module is typically not implemented to be part of a central encoder, such as the MPEG-4 AAC encoder, but is rather an additional encoder and decoder. SBR utilizes a correlation between higher and lower frequencies within an audio signal. SBR is based on the assumption that higher frequencies of a signal are merely integer multiples of a ground oscillation so that the higher frequencies can be replicated on the basis of the lower spectrum. Since the audible resolution of the human ear in the case of higher frequencies logarithmically, the low differences concerning higher frequency ranges may furthermore only be realized by very experienced listeners so that inaccuracies introduced by the SBR encoder will, most probably, be unnoticed by the vast majority of listeners.

The SBR encoder preprocesses the audio signal provided to the MPEG-4 encoder and separates the input signal into frequency ranges. The lower frequency range or frequency band is separated from an upper frequency band or frequency range by a so-called cross-over frequency, which can be set variably, depending on the available bitrate and further parameters. The SBR encoder utilizes a filterbank for analyzing the frequency, which is typically implemented to be a quadrature mirror filter band (QMF).

The SBR encoder extracts from the frequency representation of the upper frequency range energy values, which will later be used for reconstructing this frequency range based on the lower frequency band.

The SBR encoder, hence, provides SBR-data or SBR parameters along with a filtered audio signal or filtered audio data to a core encoder, which is applied to the lower frequency band based on half the sampling frequency of the original audio signal. This provides the opportunity of processing significantly less sample values so that the individual quantization levels may be more accurately set. The additional data provided by the SBR encoder, namely the SBR parameters, will be stored into a resulting bit stream by the MPEG-4 encoder or any other encoder as side information. This may be achieved by using an appropriate bit multiplexer.

On the decoder side, the incoming bit streams is first demultiplexed by a bit demultiplexer, which separates at least the SBR-data and provides same to a SBR decoder. However, before the SBR decoder processes the SBR parameters, the lower frequency band will first be decoded by a core decoder to reconstruct the audio signal of the lower frequency band. The SBR decoder itself calculates, based on the SBR energy values (SBR parameters) and the spectral information of the lower frequency range, the upper part of the spectrum of the audio signal. In other words, the SBR decoder replicates the upper spectral band of the audio signal based on the lower band as well as the SBR parameters transmitted in the previously described bit stream. Apart from the previously described possibility of the SBR-module, to enhance the overall audio perception of the reconstructed audio signal, SBR furthermore offers the possibility of encoding additional noise sources as well as individual sinusoids.

SBR, hence, represents a very flexible tool to improve the trade-off between quality and bitrate which also makes SBR an interesting candidate for applications in the field of conferencing systems. However, due to the complexity and vast number of possibilities and options, SBR-encoded audio signals have only been so far mixed in the time-domain by completely decoding the respective audio signals into time-domain signals to perform the actual mixing process in this domain and, afterwards, re-encode the mixed signal into an SBR-encoded signal. Apart from the additional delay introduced due to encoding the signals into the time-domain, also the reconstruction of the spectral information of the encoded audio signal may necessitate a significant computational complexity which may, for instance, be unattractive in the case of portable or other energy-efficient or computational complexity efficient applications.

SUMMARY

According to an embodiment, an apparatus for mixing a first frame of a first input data stream and a second frame of a second input data stream to acquire an output frame of an output data stream, wherein the first frame has first spectral data describing a lower part of a first spectrum of a first audio signal up to a first cross-over frequency and first spectral band replication data describing a higher part of the first spectrum starting from the first cross-over frequency, wherein the second frame has second spectral data describing a lower part of a second spectrum of a second audio signal up to a second cross-over frequency and second SBR-data describing a higher part of the second spectrum starting from the second cross-over frequency, wherein the first and second SBR-data describe the respective higher parts of the first and second spectrum by way of energy-related values in time/frequency grid resolutions and wherein the first cross-over frequency is different from the second cross-over frequency, may have a processing unit adapted to generate the output frame, the output frame having output spectral data describing a lower part of an output spectrum up to an output cross-over frequency and the output frame further having output SBR-data describing a higher part of the output spectrum above the output cross-over frequency by way of energy-related values in an output time/frequency grid resolution, wherein the processing unit is adapted such that the output spectral data corresponding to the frequencies below a minimum value of the first cross-over frequency, the second cross-over frequency and the output cross-over frequency is generated in a spectral domain based on the first and second spectral data; wherein the processing unit is further adapted such that the output SBR-data corresponding to the frequencies above a maximum value of the first cross-over frequency, the second cross-over frequency and the output cross-over frequency is processed in a SBR-domain based on the first and second SBR-data; and wherein the processing unit is further adapted such that for a frequency region between the minimum value and the maximum value, at least one SBR-value from at least one of a first and second spectral data is estimated and a corresponding SBR-value of the output SBR-data is generated, based on at least the estimated SBR-value.

According to another embodiment, an apparatus for mixing a first frame of a first input data stream and a second frame of a second input data stream to acquire an output frame of an output data stream, wherein the first frame has first spectral data describing a lower part of a first spectrum of a first audio signal up to a first cross-over frequency and first spectral band replication data describing a higher part of the first spectrum starting from the first cross-over frequency, wherein the second frame has second spectral data describing a lower part of a second spectrum of a second audio signal up to a second cross-over frequency and second SBR-data describing a higher part of the second spectrum starting from the second cross-over frequency, wherein the first and second SBR-data describe the respective higher parts of the first and second spectrum by way of energy-related values in time/frequency grid resolutions and wherein the first cross-over frequency is different from the second cross-over frequency, may have a processing unit adapted to generate the output frame, the output frame having output spectral data describing a lower part of an output spectrum up to an output cross-over frequency and the output frame further having output SBR-data describing a higher part of the output spectrum above the output cross-over frequency by way of energy-related values in an output time/frequency grid resolution, wherein the processing unit is adapted such that the output spectral data corresponding to the frequencies below a minimum value of the first cross-over frequency, the second cross-over frequency and the output cross-over frequency is generated in a spectral domain based on the first and second spectral data; wherein the processing unit is further adapted such that the output SBR-data corresponding to the frequencies above a maximum value of the first cross-over frequency, the second cross-over frequency and the output cross-over frequency is processed in a SBR-domain based on the first and second SBR-data; and wherein the apparatus is further adapted such that for a frequency region between the minimum value and the maximum value, at least one spectral value from at least one of the first and second frames is estimated based on the SBR-data of the respective frame, and a corresponding spectral value of the output spectral data is generated based on at least the estimated spectral value by processing same in the spectral domain.

According to another embodiment, a method for mixing a first frame of a first input data stream and a second frame of a second input data stream to acquire an output frame of an output data stream, wherein the first frame has first spectral data describing a lower part of a spectrum of a first audio signal up to a first cross-over frequency and first spectral band replication data describing a higher part of the spectrums starting from the first cross-over frequency, wherein the second frame has second spectral data describing a lower part of a second spectrum of a second audio signal up to a second cross-over frequency and second SBR-data describing a higher part of a second spectrum starting from the second cross-over frequency, wherein the first and second SBR-data describes the respective higher parts of the respective spectra by way of energy-related values in time/frequency grid resolutions, and wherein the first cross-over frequency is different from the second cross-over frequency, may have the steps of generating the output frame having output spectral data describing a lower part of an output spectrum up to an output cross-over frequency and the output frame further having output SBR-data describing a higher part of the output spectrum above the output cross-over frequency by way of energy related values in an output time/frequency grid resolution; generating spectral data corresponding to frequencies below a minimum value of the first cross-over frequency, the second cross-over frequency and an output cross-over frequency in a spectral domain based on the first and second spectral data; generating output SBR-data corresponding to frequencies above a maximum value of the first cross-over frequency, the second cross-over frequency and the output cross-over frequency in an SBR domain based on the first and second SBR-data; and estimating at least one SBR value from at least one of a first and second spectral data for a frequency in a frequency region between the minimum value and the maximum value and generating a corresponding SBR value for the output SBR-data, based on at least the estimated SBR-value; or estimating at least one spectral value from at least one of the first and second frames based on the SBR-data of the respective frame for a frequency in a frequency region between the minimum value and the maximum value and generating a spectral value of the output spectral data based on at least the estimated spectral value by processing same in the spectral domain.

According to another embodiment, a program for performing, when running on a processor, may execute a method for mixing a first frame of a first input data stream and a second frame of a second frame of a second input data stream to acquire an output frame of an output data stream, wherein the first frame has first spectral data describing a lower part of a spectrum of a first audio signal up to a first cross-over frequency and first spectral band replication data describing a higher part of the spectrums starting from the first cross-over frequency, wherein the second frame has second spectral data describing a lower part of a second spectrum of a second audio signal up to a second cross-over frequency and second SBR-data describing a higher part of a second spectrum starting from the second cross-over frequency, wherein the first and second SBR-data describes the respective higher parts of the respective spectra by way of energy-related values in time/frequency grid resolutions, and wherein the first cross-over frequency is different from the second cross-over frequency, the method having the steps of generating the output frame having output spectral data describing a lower part of an output spectrum up to an output cross-over frequency and the output frame further having output SBR-data describing a higher part of the output spectrum above the output cross-over frequency by way of energy related values in an output time/frequency grid resolution; generating spectral data corresponding to frequencies below a minimum value of the first cross-over frequency, the second cross-over frequency and an output cross-over frequency in a spectral domain based on the first and second spectral data; generating output SBR-data corresponding to frequencies above a maximum value of the first cross-over frequency, the second cross-over frequency and the output cross-over frequency in an SBR domain based on the first and second SBR-data; and estimating at least one SBR value from at least one of a first and second spectral data for a frequency in a frequency region between the minimum value and the maximum value and generating a corresponding SBR value for the output SBR-data, based on at least the estimated SBR-value; or estimating at least one spectral value from at least one of the first and second frames based on the SBR-data of the respective frame for a frequency in a frequency region between the minimum value and the maximum value and generating a spectral value of the output spectral data based on at least the estimated spectral value by processing same in the spectral domain.

Embodiments according to the present invention are based on the finding that the computational complexity may be reduced by performing the mixing for a frequency below a minimum of the cross-over frequencies involved by mixing the spectral information in the spectral domain, for a frequency above a maximum cross-over frequency in the SBR-domain, and for a frequency in a region between the minimum value and the maximum value by estimating at least one SBR-value and generating a corresponding SBR value based on the at least estimated SBR value or to estimate a spectral value or a spectral information based on the respective SBR-data and to generate a spectral value of a spectral information based on this estimated spectral value or spectral information.

In other words, embodiments according to the present invention are based on the finding that for a frequency above a maximum cross-over frequency, mixing can be performed in the SBR-domain, while for a frequency below a minimum of the cross-over frequencies, the mixing can be performed in the spectral domain by directly processing corresponding spectral values. Moreover, an apparatus according to an embodiment of the present invention may, for a frequency in between the maximum and the minimum value, perform the mixing in the SBR-domain or in the spectral domain by estimating from a corresponding SBR-value, a spectral value, or by estimating from a spectral value a SBR-value and to perform the actual mixing based on the estimated value in the SBR-domain, or in the spectral domain. In this context, it should be noted that an output cross-over frequency may be any of the cross-over frequencies of the input data streams or another value.

As a consequence, the number of steps to be performed by an apparatus and, hence, the computational complexity involved is reduced, since the actual mixing above and below all the relevant cross-over frequencies is performed based on a direct mixing in the respective domains, while an estimation is to be performed only in an intermediate region between the minimum value of all cross-over frequencies and a maximum of all cross-over frequencies involved. Based on this estimation, the actual SBR-value or the actual spectral value is then calculated or determined. Hence, in many cases, even in that intermediate frequency region, the computational complexity is reduced since an estimation and a processing need not typically be carried out for all input data streams involved.

In embodiments according to an embodiment of the present invention the output cross-over frequency may be equal to one of the cross-over frequencies of the input data streams, or it may be chosen independently, for instance, taking the result of a psychoacoustic estimation into account. Furthermore, in embodiments according to the present invention the generated SBR-data or the generated spectral values may be applied differently to smooth, or to alter, the SBR-data or spectral values in the intermediate frequency range.

BRIEF DESCRIPTION OF THE DRAWINGS

Embodiments of the present invention will be detailed subsequently referring to the appended drawings, in which.

DETAILED DESCRIPTION OF THE INVENTION

With respect to FIGS. 4 to 10, different embodiments according to the present invention will be described in more detail. However, before describing these embodiments in more detail, first with respect to FIGS. 1 to 3, a brief introduction will be given in view of the challenges and demands which may become important in the framework of conferencing systems.

Figure 1:
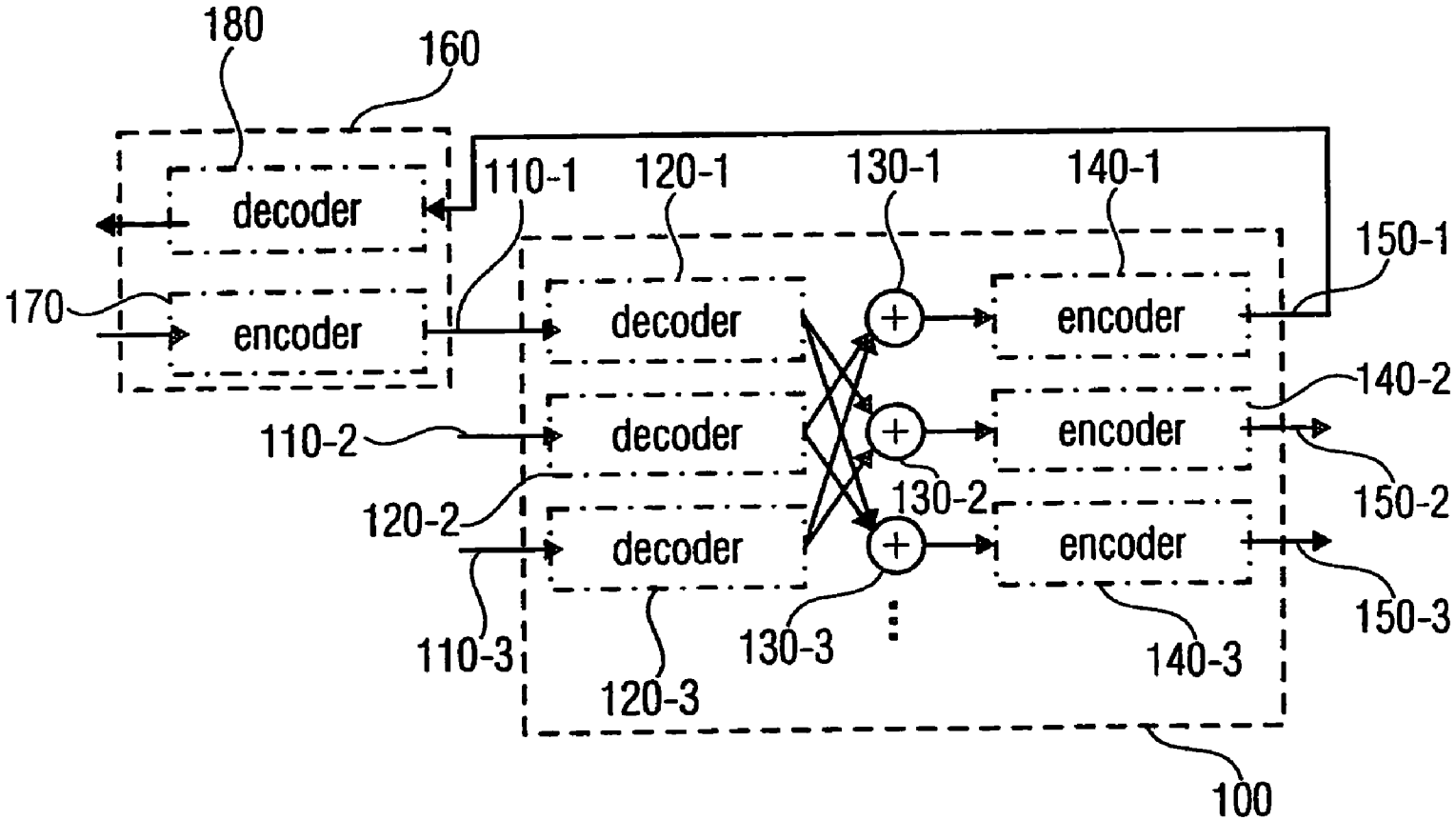
FIG. 1 shows a block diagram of a conferencing system.

FIG. 1 shows a block diagram of a conferencing system 100, which may also be referred to as a multi-point control unit (MCU). As will become apparent from the description concerning its functionality, the conferencing system 100, as shown in FIG. 1, is a system operating in the time domain.

The conferencing system 100, as shown in FIG. 1, is adapted to receive a plurality of input data streams via an appropriate number of inputs 110-1, 110-2, 110-3, . . . of which in FIG. 1 only three are shown. Each of the inputs 110 is coupled to a respective decoder 120. To be more precise, input 110-1 for the first input data stream is coupled to a first decoder 120-1, while the second input 110-2 is coupled to a second decoder 120-2, and the third input 110-3 is coupled to a third decoder 120-3.

The conferencing system 100 further comprises an appropriate number of adders 130-1, 130-2, 130-3, . . . of which once again three are shown in FIG. 1. Each of the adders is associated with one of the inputs 110 of the conferencing system 100. For instance, the first adder 130-1 is associated with the first input 110-1 and the corresponding decoder 120-1.

Each of the adders 130 is coupled to the outputs of all the decoders 120, apart from the decoder 120 to which the input 110 is coupled. In other words, the first adder 130-1 is coupled to all the decoders 120, apart from the first decoder 120-1. Accordingly, the second adder 130-2 is coupled to all the decoders 120, apart from the second decoder 120-2.

Each of the adders 130 further comprises an output which is coupled to one encoder 140, each. Hence, the first adder 130-1 is coupled output-wise to the first encoder 140-1. Accordingly, the second and third adders 130-2, 130-3 are also coupled to the second and third encoders 140-2, 140-3, respectively.

In turn, each of the encoders 140 is coupled to the respective output 150. In other words, the first encoder is, for instance, coupled to a first output 150-1. The second and third encoders 140-2, 140-3 are also coupled to second and third outputs 150-2, 150-3, respectively.

To be able to describe the operation of a conferencing system 100 as shown in FIG. 1 in more detail, FIG. 1 also shows a conferencing terminal 160 of a first participant. The conferencing terminal 160 may, for instance, be a digital telephone (e.g. an ISDN-telephone (ISDN=integrated service digital network)), a system comprising a voice-over-IP-infrastructure, or a similar terminal.

The conferencing terminal 160 comprises an encoder 170 which is coupled to the first input 110-1 of the conferencing system 100. The conferencing terminal 160 also comprises a decoder 180 which is coupled to the first output 150-1 of the conferencing system 100.

Similar conferencing terminals 160 may also be present at the sites of further participants. These conferencing terminals are not shown in FIG. 1, merely for the sake of simplicity. It should also be noted that the conferencing system 100 and the conferencing terminals 160 do by far not need to be physically present in the closer vicinity of each other. The conferencing terminals 160 and the conferencing system 100 may be arranged at different sites, which may, for instance, be connected only by means of WAN-techniques (WAN=wide area networks).

The conferencing terminals 160 may further comprise or be connected to additional components such as microphones, amplifiers and loudspeakers or headphones to enable an exchange of audio signals with a human user in a more comprehensible manner. These are not shown in FIG. 1 for the sake of simplicity only.

As indicated earlier, the conferencing system 100 shown in FIG. 1 is a system operating in the time domain. When, for example, the first participant talks into the microphone (not shown in FIG. 1), the encoder 170 of the conferencing terminal 160 encodes the respective audio signal into a corresponding bit stream and transmits the bit stream to the first input 110-1 of the conferencing system 100.

Inside the conferencing system 100, the bit stream is decoded by the first decoder 120-1 and transformed back into the time domain. Since the first decoder 120-1 is coupled to the second and third mixers 130-1, 130-3, the audio signal, as generated by the first participant may be mixed in the time domain by simply adding the reconstructed audio signal with further reconstructed audio signals from the second and third participant, respectively.

This is also true for the audio signals provided by the second and third participant received by the second and third inputs 110-2, 110-3 and processed by the second and third decoders 120-2, 120-3, respectively. These reconstructed audio signals of the second and third participants are then provided to the first mixer 130-1, which in turn, provides the added audio signal in the time domain to the first encoder 140-1. The encoder 140-1 re-encodes the added audio signal to form a bit stream and provides same at the first output 150-1 to the first participants conferencing terminal 160.

Similarly, also the second and third encoders 140-2, 140-3 encode the added audio signals in the time domain received from the second and third adders 130-2, 130-3, respectively, and transmit the encoded data back to the respective participants via the second and third outputs 150-2, 150-3, respectively.

To perform the actual mixing, the audio signals are completely decoded and added in a non-compressed form. Afterwards, optionally a level adjustment may be performed by compressing the respective output signals to prevent clipping effects (i.e. overshooting an allowable range of values). Clipping may appear when single sample values rise above or fall below an allowed range of values so that the corresponding values are cut off (clipped). In the case of a 16-bit quantization, as it is for instance employed in the case of CDs, a range of integer values between −32768 and 32767 per sample value are available.

To counteract a possible over or under steering of the signal, compression algorithms are employed. These algorithms limit the development over or below a certain threshold value to maintain the sample values within an allowable range of values.

When coding audio data in conferencing systems such as conferencing system 100, as shown in FIG. 1, some drawbacks are accepted in order to perform a mixing in the unencoded state in a most easily achievable manner. Moreover, the data rates of the encoded audio signals are additionally limited to a smaller range of transmitted frequencies, since a smaller bandwidth allows a lower sampling frequency and, hence, less data, according to the Nyquist-Shannon-Sampling theorem. The Nyquist-Shannon-Sampling theorem states that the sampling frequency depends on the bandwidth of the sampled signal and needs to be (at least) twice as large as the bandwidth.

The International Telecommunication Union (ITU) and its telecommunication standardization sector (ITU-T) have developed several standards for multimedia conferencing systems. The H.320 is the standard conferencing protocol for ISDN. H.323 defines the standard conferencing system for a packet-based network (TCP/IP). The H.324 defines conference systems for analog telephone networks and radio telecommunication systems.

Within these standards, not only transmitting the signals, but also encoding and processing of the audio data is defined. The management of a conference is taken care of by one or more servers, the so-called multi-point control units (MCU) according to standard H.231. The multi-point control units are also responsible for the processing and distribution of video and audio data of the several participants.

To achieve this, the multi-point control unit sends to each participant a mixed output or resulting signal comprising the audio data of all the other participants and provides the signal to the respective participants. FIG. 1 not only shows a block diagram of a conferencing system 100, but also a signal flow in such a conferencing situation.

In the framework of the H.323 and H.320 standards, audio codecs of the class G.7xx are defined for operation in the respective conferencing systems. The standard G.711 is used for ISDN-transmissions in cable-bound telephone systems. At a sampling frequency of 8 kHz, the G.711 standard covers an audio bandwidth between 300 and 3400 Hz, requiring a bitrate of 64 Kbit/s at a (quantization) depth of 8-bits. The coding is formed by a simple logarithmic coding called μ-Law or A-Law which creates a very low delay of only 0.125 ms.

The G.722 standard encodes a larger audio bandwidth from 50 to 7000 Hz at a sampling frequency of 16 kHz. As a consequence, the codec achieves a better quality when compared to the more narrow-banded G.7xx audio codecs at bitrates of 48, 56, or 64 Kbit/s, at a delay of 1.5 ms. Moreover, two further developments, the G.722.1 and G.722.2 exist, which provide comparable speech quality at even lower bitrates. The G722.2 allows a choice of bitrate between 6.6 kbit/s and 23.85 kbit/s at a delay of 25 ms.

The G.729 standard is typically employed in the case of IP-telephone communication, which is also referred to as voice-over-IP communications (VoIP). The codec is optimized for speech and transmits an set of analyzed speech parameters for a later synthesis along with an error signal. As a result, the G.729 achieves a significantly better coding of approximately 8 kbit/s at a comparable sample rate and audio bandwidth, when compared to the G.711 standard. The more complex algorithm, however, creates a delay of approximately 15 ms.

As a drawback, the G.7.xx codecs are optimized for speech encoding and shows, apart from a narrow frequency bandwidth, significant problems when coding music along with speech, or pure music.

Hence, although the conferencing system 100, as shown in FIG. 1, may be used for an acceptable quality when transmitting and processing speech signals, general audio signals are not satisfactorily processed when employing low-delay codecs optimized for speech.

In other words, employing codecs for coding and decoding of speech signals to process general audio signals, including for instance audio signals with music, does not lead to a satisfying result in terms of the quality. By employing audio codecs for encoding and decoding general audio signals in the framework of the conferencing system 100, as shown in FIG. 1, the quality is improvable. However, as will be outlined in the context with FIG. 2 in more detail, employing general audio codecs in such a conferencing system may lead to further, unwanted effects, such as an increased delay to name but one.

Figure 2:
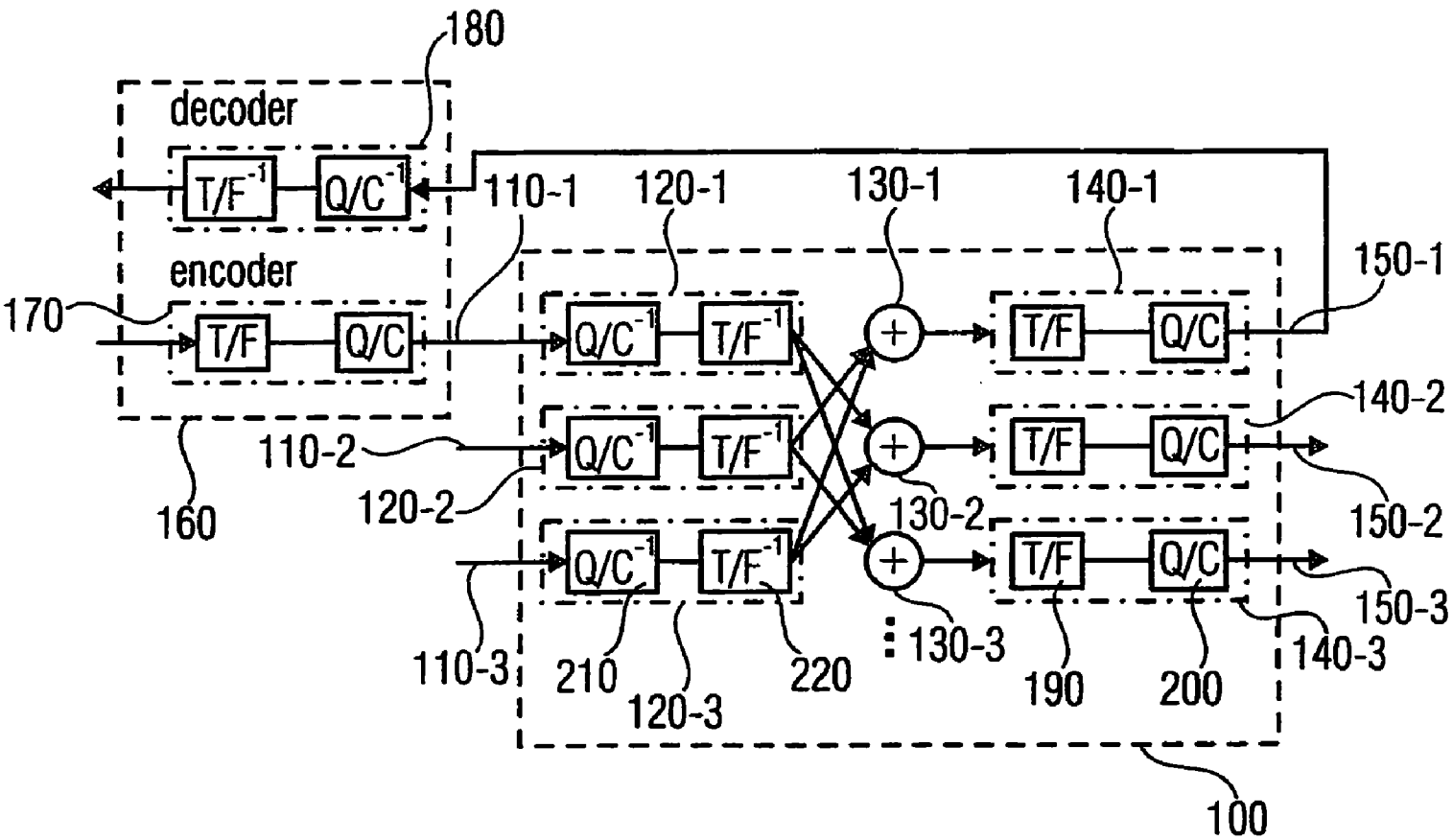
FIG. 2 shows a block diagram of the conferencing system based on a general audio codec.

However, before describing FIG. 2 in more detail, it should be noted that in the present description, objects are denoted with the same or similar reference signs when the respective objects appear more than once in an embodiment or a figure, or appear in several embodiments or figures. Unless explicitly or implicitly denoted otherwise, objects denoted by the same or similar reference signs may be implemented in a similar or equal manner, for instance, in terms of their circuitry, programming, features, or other parameters. Hence, objects appearing in several embodiments of figures and being denoted with the same or similar reference signs may be implemented having the same specifications, parameters, and features. Naturally, also deviations and adaptations may be implemented, for instance, when boundary conditions or other parameters change from figure to figure, or from embodiment to embodiment.

Moreover, in the following summarizing reference signs will be used to denote a group or class of objects, rather than an individual object. In the framework of FIG. 1, this has already been done, for instance when denoting the first input as input 110-1, the second input as input 110-2, and the third input as input 110-3, while the inputs have been discussed in terms of the summarizing reference sign 110 only. In other words, unless explicitly noted otherwise, parts of the description referring to objects denoted with summarizing reference signs may also relate to other objects bearing the corresponding individual reference signs.

Since this is also true for objects denoted with the same or similar reference signs, both measures help to shorten the description and to describe the embodiments disclosed therein in a more clear and concise manner.

FIG. 2 shows a block diagram of a further conferencing system 100 along with a conferencing terminal 160, which are both similar to these shown in FIG. 1. The conferencing system 100 shown in FIG. 2 also comprises inputs 110, decoders 120, adders 130, encoders 140, and outputs 150, which are equally interconnected as compared to the conferencing system 100 shown in FIG. 1. The conferencing terminal 160 shown in FIG. 2 also comprises again an encoder 170 and a decoder 180. Therefore, reference is made to the description of the conferencing system 100 shown in FIG. 1.

However, conferencing system 100 shown in FIG. 2, as well as the conferencing terminal 160 shown in FIG. 2 are adapted to use a general audio codec (Coder-DECoder). As a consequence, each of the encoders 140, 170, comprise a series connection of a time/frequency converter 190 coupled before a quantizer/coder 200. The time/frequency converter 190 is also illustrated in FIG. 2 as "T/F", while the quantizer/coders 200 are labeled in FIG. 2 with "Q/C".

The decoders 120, 180 each comprise a decoder/dequantizer 210, which is referred to in FIG. 2 as "$Q/C^{-1}$" connected in series with a frequency/time converter 220, which is referred to in FIG. 2 as "$T/F^{-1}$". For the sake of simplicity only, the time/frequency converter 190, the quantizer/coder 200 and the decoder/dequantizer 210, as well as the frequency/time converter 220 are labeled as such only in the case of the encoder 140-3 and the decoder 120-3. However, the following description also refers to the other such elements.

Starting with an encoder such as the encoders 140, or the encoder 170, the audio signal provided to the time/frequency converter 190 is converted from the time domain into a frequency domain or a frequency-related domain by the converter 190. Afterwards, the converted audio data are, in a spectral representation generated by the time/frequency converter 190, quantized and coded to form a bit stream, which is then provided, for instance, to the outputs 150 of the conferencing system 100 in the case of the encoder 140.

In terms of the decoders such as the decoders 120 or the decoder 180, the bit stream provided to the decoders is first decoded and re-quantized to form the spectral representation of at least a part of an audio signal, which is then converted back into the time domain by the frequency/time converters 220.

The time/frequency converters 190, as well as the inverse elements, the frequency/time converters 220 are therefore adapted to generate a spectral representation of a at least a piece of an audio signal provided thereto and to re-transform the spectral representative into the corresponding parts of the audio signal in the time domain, respectively.

In the process of converting an audio signal from the time domain into the frequency domain, and back from the frequency domain into the time domain, deviations may occur so that the re-established, reconstructed or decoded audio signal may differ from the original or source audio signal. Further artifacts may be added by the additional steps of quantizing and de-quantizing performed in the framework of the quantizer encoder 200 and the re-coder 210. In other words, the original audio signal, as well as the re-established audio signal, may differ from one another.

The time/frequency converters 190, as well as the frequency/time converters 220 may, for instance, be implemented based on a MDCT (modified discreet cosine transformation), a MDST (modified discrete sine transformation), a FFT-based converter (FFT=Fast Fourier Transformation), or another Fourier-based converter. The quantization and the re-quantization in the framework of the quantizer/coder 200 and the decoder/dequantizer 210 may for instance be implemented based on a linear quantization, a logarithmic quantization, or another more complex quantization algorithm, for example, taking more specifically the hearing characteristics of the human into account. The encoder and decoder parts of the quantizer/coder 200 and the decoder/dequantizer 210 may, for instance, work by employing a Huffman coding or Huffman decoding scheme.

However, also more complex time/frequency and frequency/time converters 190, 220, as well as more complex quantizer/coder and decoder/dequantizer 200, 210 may be employed in different embodiments and systems as described here, being part of or forming, for instance, an AAC-ELD encoder as encoders 140, 170, and a AAC-ELD-decoder as decoders 120, 180.

Needless to say that it might be advisable to implement identical, or at least compatible, encoders 170, 140 and decoders 180, 120, in the framework of the conferencing system 100 and the conferencing terminals 160.

The conferencing system 100, as shown in FIG. 2, based on a general audio signal coding and decoding scheme also performs the actual mixing of the audio signals in the time domain. The adders 130 are provided with the reconstructed audio signals in the time domain to perform a super-position and to provide the mixed signals in the time domain to the time/frequency converters 190 of the following encoders 140. Hence, the conferencing system once again comprises a series connection of decoders 120 and encoders 140, which is the reason why a conferencing system 100, as shown in FIGS. 1 and 2, are typically referred to as "tandem coding systems".

Tandem coding systems often show the drawback of a high complexity. The complexity of mixing strongly depends on the complexity of the decoders and encoders employed, and may multiply significantly in the case of several audio input and audio output signals. Moreover, due to the fact that most of the encoding and decoding schemes are not lossless, the tandem coding scheme, as employed in the conferencing systems 100 shown in FIGS. 1 and 2, typically lead to a negative influence on quality.

As a further drawback, the repeated steps of decoding and encoding also enlarges the overall delay between the inputs 110 and the outputs 150 of the conferencing system 100, which is also referred to as the end-to-end delay. Depending on an initial delay of the decoders and encoders used, the conferencing system 100 itself, may increase the delay up to a level which makes the use in the framework of the conferencing system unattractive, if not disturbing, or even impossible. Often a delay of approximately 50 ms is considered to be the maximum delay which participants may accept in conversations.

As main sources for the delay, the time/frequency converters 190, as well as the frequency/time converters 220 are responsible for the end-to-end delay of the conferencing system 100, and the additional delay imposed by the conferencing terminals 160. The delay caused by the further elements, namely the quantizers/coders 200 and the decoders/dequantizers 210 is of less importance since these components may be operated at a much higher frequency compared to the time/frequency converters and the frequency/time converters 190, 220. Most of the time/frequency converters and frequency/time converters 190, 220 are block-operated or frame-operated, which means that in many cases a minimum delay as an amount of time has to be taken into account, which is equal to the time needed to fill a buffer or a memory having the length of frame of a block. This time is, however, significantly influenced by the sampling frequency which is typically in the range of a few kHz to a few 10 kHz, while the operational speed of the quantizer/coders 200, as well as the decoder/dequantizer 210 is mainly determined by the clock frequency of the underlying system. This is typically at least 2, 3, 4, or more orders of magnitude larger.

Hence, in conferencing systems employing general audio signal codecs the so-called bit stream mixing technology has been introduced. The bit stream mixing method may, for instance, be implemented based on the MPEG-4 AAC-ELD codec, which offers the possibility of avoiding at least some of the drawbacks mentioned above and introduced by tandem coding.

It should however be noted that, in principle, the conferencing system 100 as shown in FIG. 2, may also be implemented based on the MPEG-4 AAC-ELD codec with a similar bit rate and a significantly larger frequency bandwidth, compared to the previously mentioned speech-based codes of the G.7xx codec family. This immediately also implies that a significantly better audio quality for all signal types may be achievable at the cost of a significantly increased bitrate. Although the MPEG-4 AAC-ELD offers a delay which is in the range of that of the G.7xx codec, implementing same in the framework of a conferencing system as shown in FIG. 2, may not lead to a practical conferencing system 100. In the following, with respect to FIG. 3, a more practical system based on the previously mentioned so-called bit stream mixing will be outlined.

It should be noted that for the sake of simplicity only, the focus will mainly be laid on the MPEG-4 AAC-ELD codec and its data streams and bit streams. However, also other encoders and decoders may be employed in the environment of a conferencing system 100 as illustrated and shown in FIG. 3.

Figure 3:
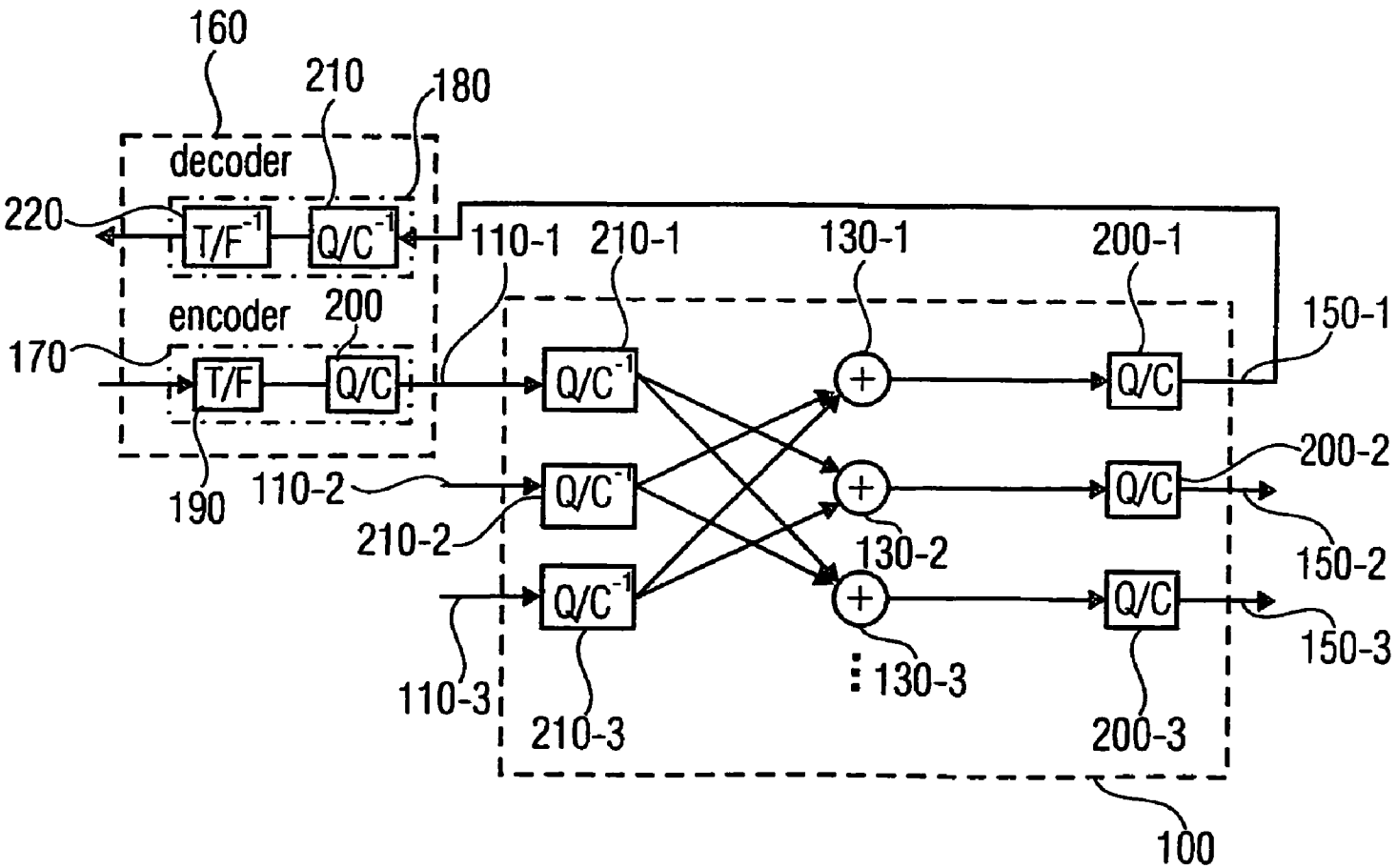
FIG. 3 shows a block diagram of a conferencing system operating in a frequency domain using the bit stream mixing technology.

FIG. 3 shows a block diagram of a conferencing system 100 working according to the principle of bit stream mixing along with a conferencing terminal 160, as described in the context of FIG. 2. The conferencing system 100 itself is a simplified version of the conferencing system 100 shown in FIG. 2. To be more precise, the decoders 120 of the conferencing system 100 in FIG. 2 have been replaced by decoders/dequantizers 220-1, 220-2, 210-3, . . . as shown in FIG. 3. In other words, the frequency/time converters 120 of the decoders 120 have been removed when comparing the conferencing system 100 shown in FIGS. 2 and 3. Similarly, the encoders 140 of the conferencing system 100 of FIG. 2 have been replaced by quantizer/coders 200-1, 200-2, 200-3. Hence, the time/frequency converters 190 of the encoders 140 have been removed when comparing the conferencing system 100 shown in FIGS. 2 and 3.

As a result, the adders 130 no longer operate in the time domain, but, due to the lack of the frequency/time converters 220 and the time/frequency converters 190, in the frequency or in a frequency-related domain.

For instance, in the case of the MPEG-4 AAC-ELD codecs, the time/frequency converter 190 and the frequency/time converter 220, which are only present in the conferencing terminals 160, are based on a MDCT-transformation. Therefore, inside the conferencing system 100, the mixers 130 directly at the contributions of the audio signals in the MDCT-frequency representation.

Since the converters 190, 220 represent the main source of delay in the case of the conferencing system 100 shown in FIG. 2, the delay is significantly reduced by removing these converters 190, 220. Moreover, the complexity introduced by the two converters 190, 220 inside the conferencing system 100 is also significantly reduced. For instance, in the case of a MPEG-2 AAC-decoder, the inverse MDCT-transformation carried out in the framework of the frequency/time converter 220 is responsible for approximately 20% of the overall complexity. Since also the MPEG-4 converter is based on a similar transformation, a non-irrelevant contribution to the overall complexity may be removed by removing the frequency/time converter 220 alone from the conferencing system 100.

Mixing audio signals in the MDCT-domain, or another frequency-domain is possible, since in the case of an MDCT-transformation or in the case of a similar Fourier-based transformation, these transformations are linear transformations. The transformations, therefore, possess the property of the mathematical additivity, namely $$f(x+y)=f(x)+f(y), \tag{1}$$

and that of mathematical homogeneity, namely $$f(a\cdot x)=a\cdot f(x), \tag{2}$$

wherein f(x) is an the transformation function, x and y suitable arguments thereof and a real-valued or complex-valued constant.

Both features of the MDCT-transformation or another Fourier-based transformation allow for a mixing in the respective frequency domain similar to mixing in the time domain. Hence, all calculations may equally well be carried out based on spectral values. A transformation of the data into the time domain is not essential.

Under some circumstances, a further condition might have to be met. All the relevant spectral data should be equal with respect to their time indices during the mixing process for all relevant spectral components. This may eventually not be the case if, during the transformation the so-called block-switching technique is employed so that the encoder of the conferencing terminals 160 may freely switch between different block lengths, depending on certain conditions. Block switching may endanger the possibility of uniquely assigning individual spectral values to samples in the time domain due to the switching between different block lengths and corresponding MDCT window lengths, unless the data to be mixed have been processed with the same windows. Since in a general system with distributed conferencing terminals 160, this may eventually not be guaranteed, complex interpolations might become essential which in turn may create additional delay and complexity. As a consequence, it may eventually be advisable not to implement a bit stream mixing process based on switching block lengths.

In contrast, the AAC-ELD codec is based on a single block length and, therefore, is capable of guaranteeing more easily the previously described assignment or synchronization of frequency data so that a mixing can more easily be realized. The conferencing system 100 shown in FIG. 3 is, in other words, a system which is able to perform the mixing in the transform-domain or frequency domain.

As previously outlined, in order to eliminate the additional delay introduced by the converters 190, 200 in the conference system 100 shown in FIG. 2, the codecs used in the conferencing terminals 160 use a window of fixed length and shape. This enables the implementation of the described mixing process directly without transforming the audio stream back into the time domain. This approach is capable of limiting the amount of additionally introduced algorithmic delay. Moreover, the complexity is decreased due to the absence of the inverse transform steps in the decoder and the forward transform steps in the encoder.

However, also in the framework of a conferencing system 100 as shown in FIG. 3, it may become essential to re-quantize the audio data after the mixing by the adders 130, which may introduce additional quantization noise. The additional quantization noise may, for instance, be created due to different quantization steps of different audio signals provided to the conferencing system 100. As a result, for example in the case of very low bitrate transmissions in which a number of quantization steps are already limited, the process of mixing two audio signals in the frequency domain or transformation domain may result in an undesired additional amount of noise or other distortions in the generated signal.

Figure 4:
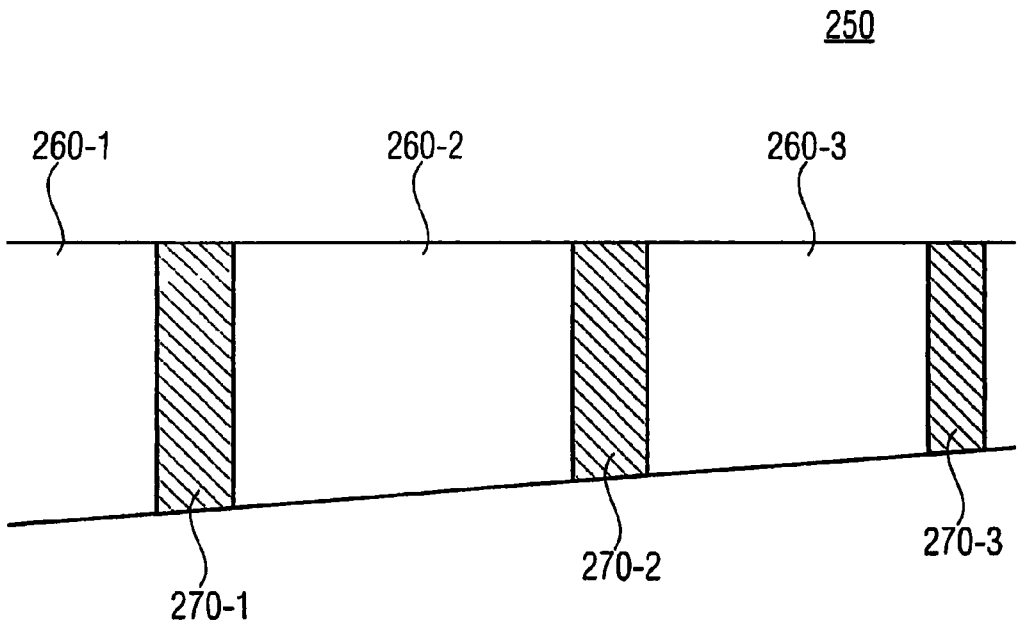
FIG. 4 shows a schematic drawing of data stream comprising a plurality of frames.

Before describing a first embodiment according to the present invention in the form of an apparatus for mixing a plurality of input data streams, with respect to FIG. 4, a data stream or bit stream, along with data comprised therein, will shortly be described.

FIG. 4 schematically shows a bit stream or data stream 250 which comprises at least one or, more often, more than one frame 260 of audio data in a spectral domain. More precisely, FIG. 4 shows three frames 260-1, 260-2, and 260-3 of audio data in a spectral domain. Moreover, the data stream 250 may also comprise additional information or blocks of additional information 270, such as control values indicating, for instance, a way the audio data are encoded, other control values or information concerning time indices or other relevant data. Naturally, the data stream 250 as shown in FIG. 4 may further comprise additional frames or a frame 260 may comprise audio data of more than one channel. For instance, in the case of a stereo audio signal, each of the frames 260 may, for instance, comprise audio data from a left channel, a right channel, audio data derived from both, the left and right channels, or any combination of the previously mentioned data.

Hence, FIG. 4 illustrates that a data stream 250 may not only comprise a frame of audio data in a spectral domain, but also additional control information, control values, status values, status information, protocol-related values (e.g. check sums), or the like.

Figure 5:
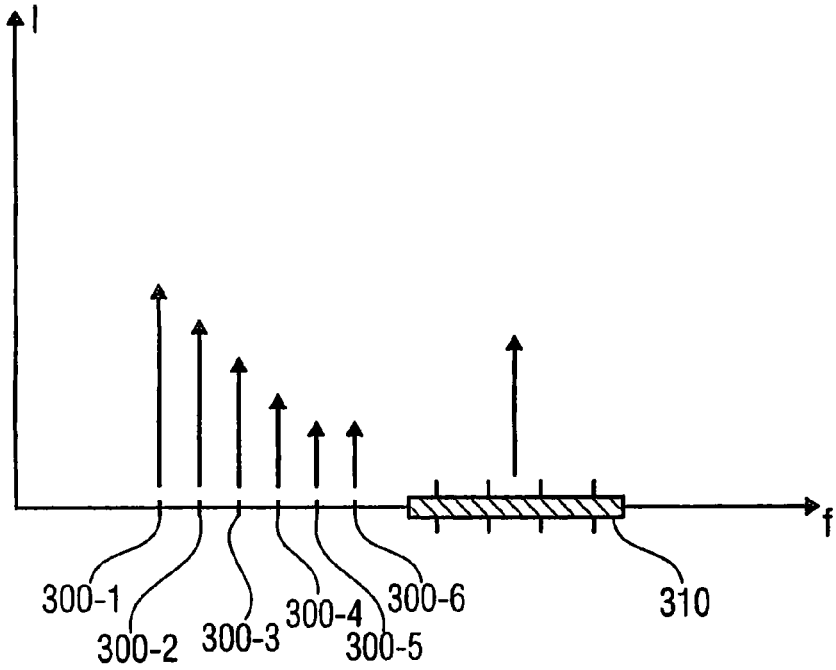
FIG. 5 illustrates different forms of spectral components and spectral data or information.

FIG. 5 schematically illustrates (spectral) information concerning spectral components as, for instance, comprised in the frame 260 of the data stream 250. To be more precise, FIG. 5 shows a simplified diagram of information in a spectral domain of a single channel of a frame 260. In the spectral domain, a frame of audio data may, for instance, be described in terms of its intensity values I as a function of the frequency f. In discrete systems, such as for instance digital systems, also the frequency resolution is discrete, so that the spectral information is typically only present for certain spectral components such as individual frequencies or narrow bands or subbands. Individual frequencies or narrow bands, as well as subbands, are referred to as spectral components.

FIG. 5 schematically shows an intensity distribution for six individual frequencies 300-1, . . . , 300-6, as well as a frequency band or subband 310 comprising, in the case as illustrated in FIG. 5, four individual frequencies. Both, individual frequencies or corresponding narrow bands 300, as well as the subband or frequency band 310, form spectral components with respect to which the frame comprises information concerning the audio data in the spectral domain.

The information concerning the subband 310 may, for instance, be an overall intensity, or an average intensity value. Apart from intensity or other energy-related values such as the amplitude, the energy of the respective spectral component itself, or another value derived from the energy or the amplitude, phase information and other information may also be comprised in the frame and, hence, be considered as information concerning a spectral component.

The operational principles of an embodiment according to the present invention are not such that mixing is done in a straightforward manner in the sense that all incoming streams are decoded, which includes an inverse transformation to the time-domain, mixing and again re-encoding the signals.

Embodiments according to the present invention are based on mixing done in the frequency domain of the respective codec. A possible codec could be the AAC-ELD codec, or any other codec with a uniform transform window. In such a case, no time/frequency transformation is needed to be able to mix the respective data. Embodiments according to an embodiment of the present invention make use of the fact that access to all bit stream parameters, such as quantization step size and other parameters, is possible and that these parameters can be used to generate a mixed output bit stream.

Embodiments according to an embodiment of the present invention make use of the fact that mixing of spectral lines or spectral information concerning spectral components can be carried out by a weighted summation of the source spectral lines or spectral information. Weighting factors can be zero or one, or in principle, any value in between. A value of zero means that sources are treated as irrelevant and will not be used at all. Groups of lines, such as bands or scale factor bands may use the same weighting factor in the case of embodiments according to the present invention. However, as illustrated before, the weighting factors (e.g. a distribution of zeros and ones) may be varied for the spectral components of a single frame of a single input data stream. Moreover, embodiments according to an embodiment of the present invention do by far not need to exclusively use the weighting factors zero or one when mixing spectral information. It may be the case that under some circumstances, not for a single, one, a plurality of overall spectral information of a frame of an input data stream, the respective weighting factors may be different from zero or one.

One particular case is that all bands or spectral component of one source (input data stream 510) are set to a factor of one and all factors of the other sources are set to zero. In this case, the complete input bit stream of one participant is identically copied as a final mixed bit stream. The weighting factors may be calculated on a frame-to-frame basis, but may also be calculated or determined based on longer groups or sequences of frames. Naturally, even inside such a sequence of frames or inside single frames, the weighting factors may differ for different spectral components, as outlined above. The weighting factors may, in some embodiments according to an embodiment of the present invention, be calculated or determined according to results of the psychoacoustic model.

A psychoacoustic model or a respective module may calculate the energy ratio r(n) between a mixed signal where only some input streams are included leading to an energy value $E_f$ and the complete mixed signal having an energy value $E_c$. The energy ratio r(n) is then calculated as 20 times the logarithmic of $E_f$ divided by $E_c$.

If the ratio is high enough, the less dominant channels may be regarded as masked by the dominant ones. Thus, an irrelevance reduction is processed meaning that only those streams are included which are not at all noticeable, to which a weighting factor of one is attributed, while all the other streams—at least one spectral information of one spectral component—are discarded. In other words, to these a weighting factor of zero is attributed.

To be more specific, this may, for instance, be achieved according to $$E_c = \sum_{n=1}^{N} E_n \tag{3}$$

and $$E_{f(n)} = \sum_{\substack{n=1 \\ n \neq 1}}^{N} E_i \tag{4}$$

and calculating the ratio r(n) according to $$r(n) = 20 \cdot \log \frac{E_{f(n)}}{E_c}, \tag{5}$$

wherein n is an index of an input data stream and N is the number of all or the relevant input data streams. If the ratio r(n) is high enough, the less dominant channels or less dominant frames of input data streams 510 may be seen as masked by the dominant ones. Thus, an irrelevance reduction may be processed, meaning that only those spectral components of a stream are included which are at all noticeable, while the other streams are discarded.

The energy values which are to be considered in the framework of equations (3) to (5) may, for instance, be derived from the intensity values by calculating the square of the respective intensity values. In case information concerning the spectral components may comprise other values, a similar calculation may be carried out depending on the form of the information comprised in the frame. For instance, in the case of complex-valued information, calculating the modulus of the real and the imaginary components of the individual values making up the information concerning the spectral components may have to be performed.

Apart from individual frequencies, for the application of the psychoacoustic module according to equations (3) to (5), the sums in equations (3) and (4) may comprise more than one frequency. In other words, in equations (3) and (4) the respective energy values $E_n$ may be replaced by an overall energy value corresponding to a plurality of individual frequencies, an energy of a frequency band, or to put it in more general terms, by a single piece of spectral information or a plurality of spectral information concerning one or more spectral components.

For instance, since the AAC-ELD operates on spectral lines in a band-wise manner, similar to frequency groups in which the human auditory system treats at the same time, the irrelevance estimation or the psychoacoustic model may be carried out in a similar manner. By applying the psychoacoustic model in this manner, it is possible to remove or substitute part of a signal of only a single frequency band, if needed.

As psychoacoustic examinations have shown, masking of a signal by another signal depends on the respective signal types. As a minimum threshold for an irrelevance determination, a worst case scenario may be applied. For instance, for masking noise by a sinusoid or another distinct and well-defined sound, a difference of 21 to 28 dB is typically essential. Tests have shown that a threshold value of approximately 28.5 dB yields good substitute results. This value may eventually be improved, also taking the actual frequency bands under consideration into account.

Hence, values r(n) according to equation (5) being larger than −28.5 dB may be considered to be irrelevant in terms of a psychoacoustic evaluation or irrelevance evaluation based on the spectral component or the spectral components under consideration. For different spectral components, different values may be used. Thus, using thresholds as indicators for a psychoacoustic irrelevance of an input data stream in terms of the frame under consideration of 10 dB to 40 dB, 20 dB to 30 dB, or 25 dB to 30 dB may be considered useful.

An advantage that less or no tandem coding effects occur due to a reduced number of re-quantization steps may arise. Since each quantization step bares a significant danger of reducing additional quantization noise, the overall quality of the audio signal may be improved by employing an embodiment according to the present invention in the form of an apparatus for mixing a plurality of input data streams. This may be the case when the output data stream is generated such that a distribution of quantization levels compared to a distribution of quantization levels of the frame of the determined input stream or parts thereof is maintained.

Figure 6A:
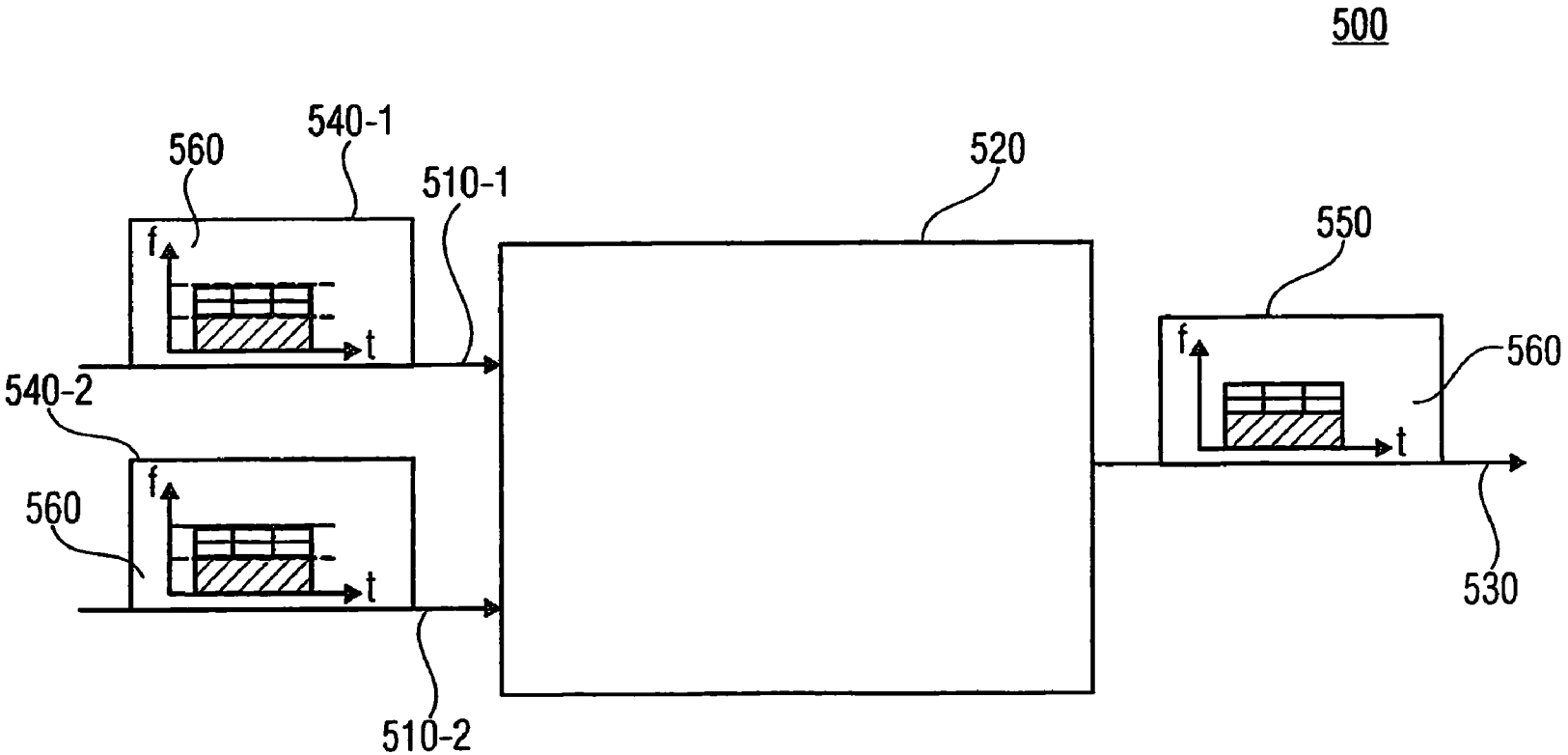
FIG. 6*a* shows a simplified block diagram of an apparatus for mixing a first frame of a first input data stream and a second frame of a second input data stream according to an embodiment of the present invention.

FIG. 6*a* shows a simplified block diagram of an apparatus 500 for mixing frames of a first input data stream 510-1 and a second input data stream 510-2. The apparatus 500 comprises a processing unit 520 which is adapted to generate an output data stream 530. To be slightly more precise, the apparatus 500 and the processing unit 520 are adapted to generate, based on a first frame 540-1 and a second frame 540-2 of the first and second input data streams 510-1, 510-2, respectively, an output frame 550 comprised in the output data stream 530.

Both, the first frame 540-1 and the second frame 540-2 each comprise spectral information concerning a first and second audio signal, respectively. The spectral information are separated into a lower part of a spectrum and a higher part of the respective spectrum, wherein the higher part of the spectrum is described by SBR-data in terms of energy or energy-related values in a time/frequency grid resolution. The lower part and the higher part of the spectrum are separated from one another at a so-called cross-over frequency, which is one of the SBR-parameters. The lower parts of the spectrum are described in terms of spectral values inside the respective frames 540. In FIG. 6*a*, this is schematically illustrated by a schematic representation of the spectral information 560. The spectral information 560 will be described in more detail in context with FIG. 6*b* below.

Naturally, it may advisable to implement an embodiment according to the present invention in the form of an apparatus 500 such that in the case of a sequence of frames 540 in an input data stream 510, only frames 540 will be considered during the comparison and determination, which correspond to a similar or same time index.

The output frame 550 also comprises the similar spectral information representation 560, which is also schematically shown in FIG. 6*a*. Accordingly, also the output frame 550 comprises a similar spectral information representation 560 with a higher part of an output spectrum and a lower part of an output spectrum which touches each other at the output cross-over frequency. Similar to the frames 540 of the input data streams 510, also the lower part of the output spectrum of the output frame 550 is described in terms of output spectral values, while the upper part of the spectrum (higher part) is described in terms of SBR-data comprising energy values in an output time/frequency rid resolution.

As indicated above, the processing unit 520 is adapted to generate and output the output frame as describe above. It should be noted that in general cases the first cross-over frequency of the first frame 540-1 and the second cross-over frequency of the second frame 540-2 are different. As a consequence, the processing unit is adapted such that the output spectral data corresponding to frequencies below a minimum value of a first cross-over frequency, the second cross-over frequency and the output cross-over frequency is generated directly in a spectral domain based on a first and second spectral data. This may, for instance, be achieved by adding or linearly combining the respective spectral information corresponding to the same spectral components.

Moreover, the processing unit 520 is further adapted to generate the output SBR-data describing the upper part of the output spectrum of the output frame 550 by processing the respective first and second SBR-data of the first and second frames 540-1, 540-2 directly in the SBR-domain. This will be explained in more detail with respect to FIGS. 9*a* to 9*e*.

As will also be explained in more detail below, the processing unit 520 may be adapted such that for a frequency region between the minimum value and the maximum value, as defined above, at least one SBR-value from at least one of a first and second spectral data is estimated and a corresponding SBR-value of the output SBR-data is generated based on at least that estimated SBR-value. This may, for instance, be the case when the frequency and the consideration of a spectral component under consideration is lower than the maximum cross-over frequency involved, but higher than the minimum value thereof.

In such a situation, it may occur that at least one of the input frames 540 comprises spectral values as part of the lower part of the respective spectrum, while the output frame expects SBR-data, since the respective spectral component lies above the output cross-over frequency. In other words, in this intermediate frequency region between the minimum value of the cross-over frequencies involved and the maximum value of the cross-over frequency values involved, it may occur that based on spectral data from a lower part of one of the spectra corresponding SBR-data have to be estimated. The output SBR-data corresponding to the spectral component under consideration are then based at least on the estimated SBR-data. A more detailed description on how this may be carried out according to an embodiment of the present invention will be presented in context with FIGS. 9*a* to 9*e* below.

On the other hand, it may occur that for a spectral component or a frequency involved, which lie in the previously defined intermediate frequency region, the output frame 550 expects spectral values since the respective spectral component belongs to the lower part of the output spectrum. However, one of the input frames 540 may only comprise SBR-data for the relevant spectral component. In this case, it may be advisable to estimate the corresponding spectral information based on the SBR-data and, optionally, based on the spectral information, or at least parts thereof, of the lower part of the spectrum of the input frame under consideration. In other words, also an estimation of spectral data based on SBR-data may be essential under some circumstances. Based on the estimated spectral value, the corresponding spectral value of the respective spectral component may then be determined or obtained by directly processing same in the spectral domain.

Figure 6B:
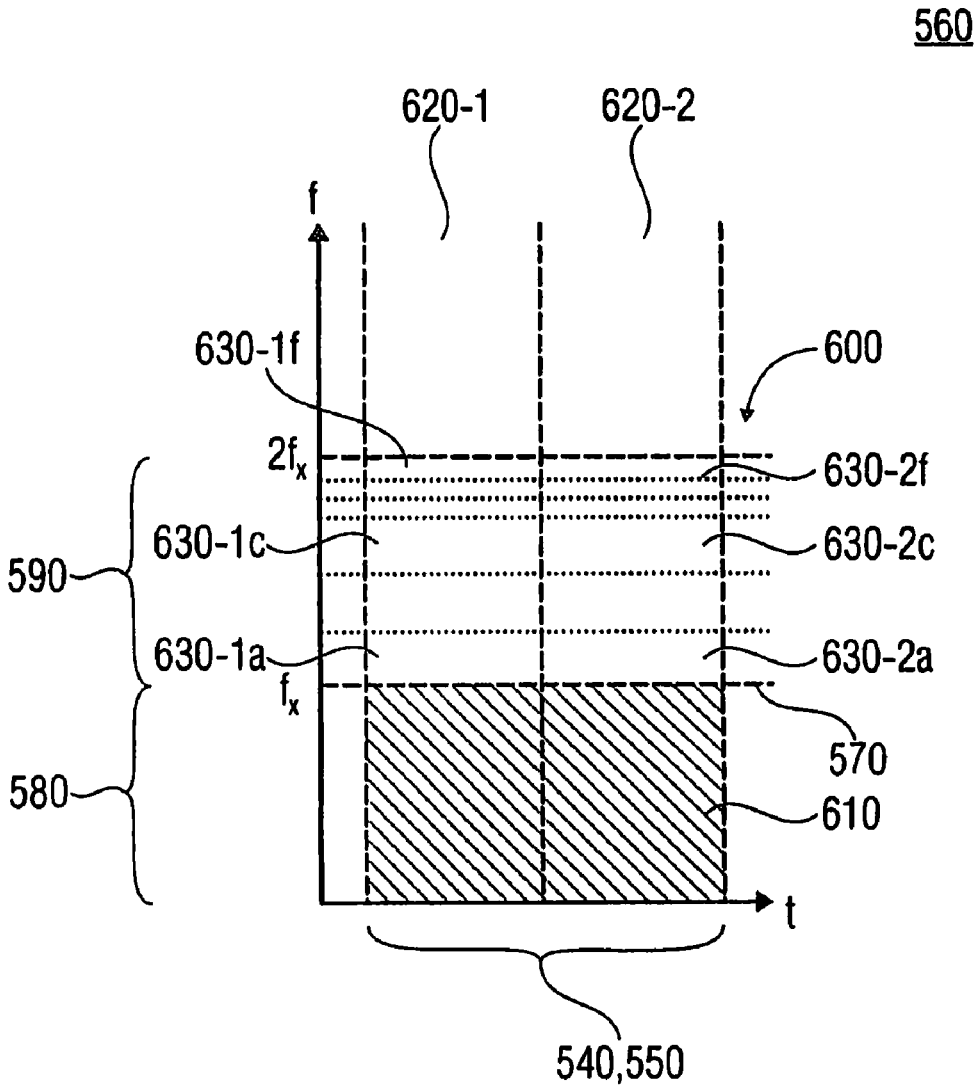
FIG. 6*b* shows a block diagram of a time/frequency grid resolution of a frame of a data stream.

However, to facilitate a better understanding of the processes and operations of an apparatus 500 according to an embodiment of the present invention and SBR in general, FIG. 6*b* shows a more detailed representation 560 of spectral information employing SBR-data.

As outlined in the introductory parts of the specification, the SBR tool or SBR-module operates typically as a separate encoder or decoder next to the basic MPEG-4 encoders or decoders. The SBR tool is based on employing a quadrature mirror filterbank (QMF) which also represents a linear transformation.

The SBR tool stores, within the data stream or bit stream of the MPEG encoder, its own pieces of information and data (SBR-parameters) to facilitate correct decoding of the frequency data described. Pieces of information will be described in terms of the SBR tool as frame grid or time/frequency grid resolution. The time/frequency grid comprises data with respect to the present frame 540, 550 only.

FIG. 6*b* schematically shows such a time/frequency grid for a single frame 540, 550. While the abscissa is a time axis, the ordinate is a frequency axis.

The spectrum displayed in terms of its frequency f is separated, as illustrated before, by the previously defined cross-over frequency ($f_x$) 570 into a lower part 580 and an upper or higher part 590. While the lower part 580 of the spectrum typically extends from the lowest accessible frequency, e.g. 0 Hz), up to the cross-over frequency 570, the upper part 590 of the spectrum begins at the cross-over frequency 570 and typically ends at twice the cross-over frequency ($2f_x$), as indicated in FIG. 6*b* by a line 600.

The lower part 580 of the spectrum is typically described by a spectral data or spectral values 610 as a hatched area since in many frame-based codecs and their time/frequency converters, the respective frame of audio data is completely transferred into the frequency domain so that the spectral data 610 typically do not comprise an explicit frame internal time dependency. As a consequence, in terms of the lower part 580 of the spectrum, the spectral data 610 may not be fully correctly displayed in such a time time/frequency coordinate system shown in FIG. 6*b*.

However, as outlined above, the SBR tool operates based on a QMF time/frequency conversion separating at least the upper part of the spectrum 590 into a plurality of subbands, wherein each of the subband signals comprises a time dependency or time resolution. In other words, the conversion into the subband domain as performed by the SBR tool creates a "mixed time and frequency representation".

As outlined in the introductory parts of the specification, based on the assumption that the upper part of the spectrum 590 bares a significant resemblance to the lower part 580 and, hence, a significant correlation, the SBR tool is capable of deriving energy-related or energy values to describe in terms of the frequency manipulation of the amplitude of the spectral data of the lower part 580 of the spectrum copied to the frequencies in the spectral components of the upper part 590. Therefore, by copying the spectral information from the lower part 580 into the frequencies of the upper part 590, and modifying their respective amplitudes, the upper part 590 of the spectral data is replicated, as suggested by the name of the tool.

While the time resolution of the lower part 580 of the spectrum is inherently present, for instance, by including phase information or other parameters, the subband description of the upper part 590 of a spectrum allows a direct access to the time resolution.

The SBR tool generates the SBR-parameters comprising a number of time slots for each SBR-frame, which is identical to the frames 540, 550, in case the SBR-frame lengths and the underlying encoder frame lengths are compatible and, neither the SBR tool, nor the underlying encoder or decoder use a block switching technique. This boundary condition is, for instance, fulfilled by the MPEG-4 AAC-ELD codec.

The time slots divide the time access of the frame 540, 550 of the SBR-module in small equally spaced time regions. The number of these time regions in each SBR-frame is determined prior to encoding the respective frame. The SBR tool used in context with the MPEG-4 AAC-ELD codec is set to 16 time slots.

These time slots are then combined to form one or more envelopes. An envelope comprises at least two or more time slots, formed into a group. Each of the envelopes has a specific number of SBR frequency data with which it is associated. In the frame grid, the number and the length in terms of time slots will be stored with each envelope.

The simplified representation of the spectral information 560 shown in FIG. 60 shows a first and a second envelope 620-1, 620-2. Although in principle, the envelope 620 may be freely defined, even having a length of less than two time slots, in the framework of the MPEG-4 AAC-ELD codec, the SBR-frames belong to any of two classes, the FIXFIX class and the LD_TRAN class only. As a consequence, although in principle any distribution of the time slots in terms of the envelopes is possible, in the following reference will mainly be made to the MPEG-4 AAC-ELD codec so that implementations thereof will mainly be described.

The FIXFIX-class divides the 16 available time slots into a number of equally long envelopes (e.g. 1, 2, 4, comprising 16, 6, 4 time slots each, respectively), while the LD_TRAN class comprises two or three envelopes of which one exactly comprises two slots. The envelope comprising exactly two time slots comprises a transient in the audio signal, or in other words, the abrupt change of the audio signal such as a very loud and sudden sound. The time slots before and after this transient may be comprised in up to two further envelopes provided that the respective envelopes are sufficiently long.

In other words, since the SBR-module enables a dynamic division of the frames into envelopes, it is possible to react to transients in the audio signal with a more accurate frequency resolution. In case a transient is present in the current frame, the SBR encoder divides the frame into an appropriate envelope structure. As outlined before, the frame division is standardized in the case of AAC-ELD along with SBR and depends on the position of the transient in terms of the time slots as characterized by the variable TRANPOS.

The SBR-frame class chosen by the SBR encoder in case a transient is present, the LD_TRAN class typically comprises three envelopes. The starting envelope comprises the beginning of the frame up to the position of the transient with time slot indices from zero to TRANPOS−1, the transient will be enclosed by an envelope comprising exactly two time slots with time slot indices from TRANPOS to TRANPOS+2. The third envelope comprises all the following time slots with indices TRANPOS+3 to TRANPOS+16. However, the minimum length of an envelope in the AAC-ELD codec along with SBR is limited to two time slots so that frames with a transient close to a frame border will only be divided into two envelopes.

In FIG. 6*b* a situation is shown in which the two envelopes 620-1, 620-2 are equally long belonging to the FIXFIX SBR-frame class with a number of two envelopes. Accordingly, each of the envelopes comprises a length of 8 time slots.

The frequency resolution attributed to each of the envelopes determines the number of energy values or SBR energy values to be calculated for each envelope and stored with respect thereto. The SBR tool in context with the AAC-ELD codec may be switched between a high and a low resolution. In the case of a highly resolved envelope, when compared to a low resolved envelope. Twice as many energy values will be used to enable a more precise frequency resolution for this envelope in the case of a highly resolved envelope, when compared to a low resolved envelope. The number of frequency values for a high or a low resolve envelope depends on encoder parameters such as bitrate, sampling frequency and other parameters. In case of the MPEG-4 AAC-ELD codec, the SBR tool very often uses 16 to 14 values in highly resolved envelopes. Accordingly in low resolved envelopes the number of energy values is often in the range between 7 and 8 per envelope.

FIG. 6*b* shows for each of the two envelopes 620-1, 620-2, 6 time/frequency regions 630-1*a*, . . . , 630-1*f*, 630-2*a*, . . . , 630-2*f*, each of the time/frequency regions representing one energy or energy-related SBR value. For the sake of simplicity only, three of the time/frequency regions 630 for each of the two envelopes 620-1, 620-2 have been labeled as such. Moreover, for the same reason, the frequency distribution of the time/frequency region 630 for the two envelopes 620-1, 620-2 have been chosen identically. Naturally, this represents only one possibility among a significant number of possibilities. To be more precise, the time/frequency regions 630 may be individually distributed for each of the envelopes 620. It is, therefore, by far not essential to divide the spectrum or its upper part 590 into the same distribution when switching between envelopes 620. It should also be noted that the number of time/frequency regions 630 may equally well depend on the envelope 620 under consideration as indicated above.

Moreover, as additional SBR-data, noise-related energy values and sinusoid-related energy values may also be comprised in each of the envelopes 620. These additional values have merely for the sake of simplicity not been shown. While the noise-related values describe an energy value with respect to the energy value of the respective time/frequency region 630 of a predefined noise source, the sinusoid energy values relate to sine-oscillations with predefined frequencies and an energy value equal to that of the respective time/frequency region. Typically, two to three of the noise-related or the sinusoid-related values may be included per envelope 620. However, also a smaller or larger number may be included.

Figure 7:
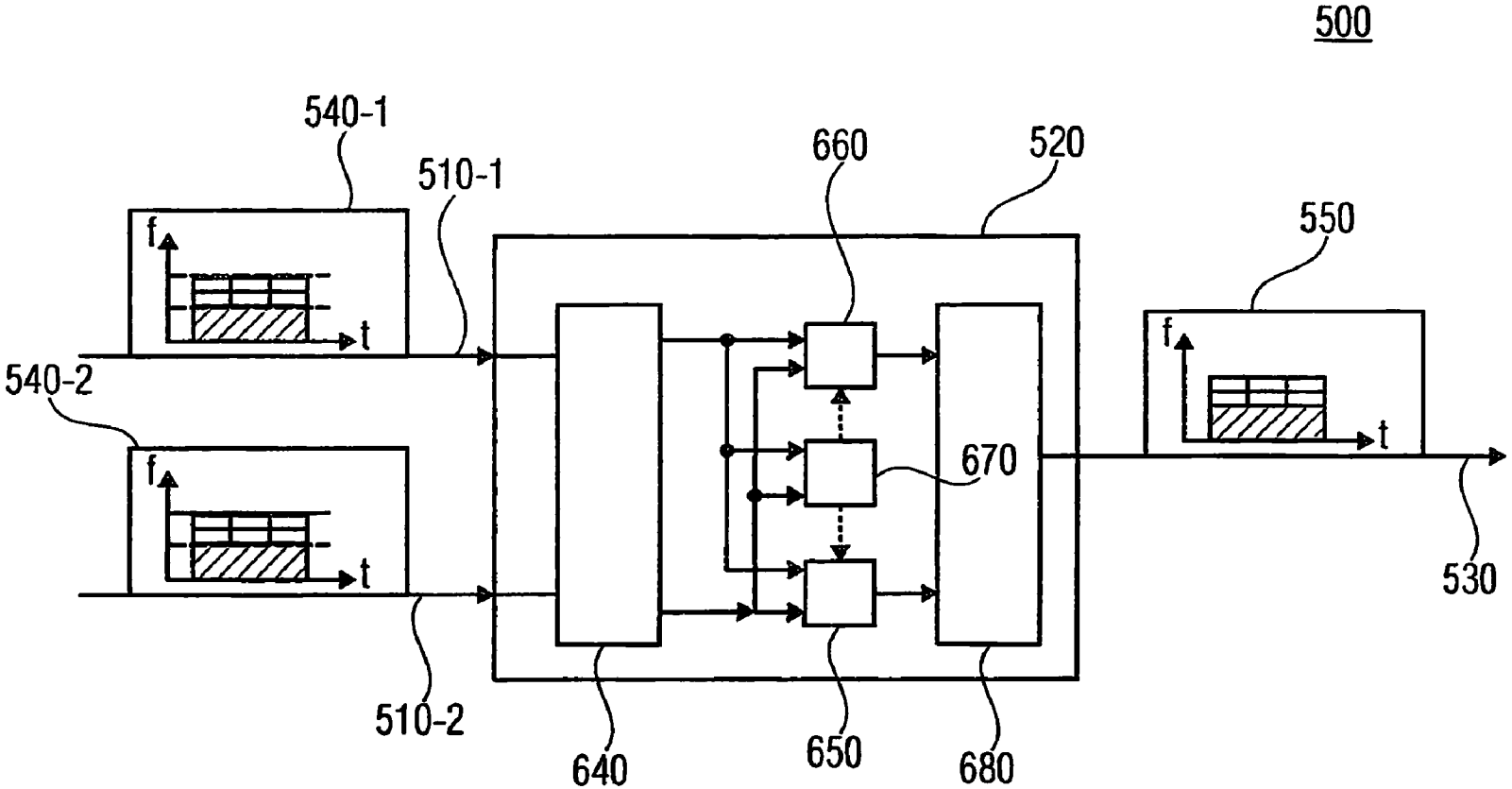
FIG. 7 shows a more detailed block diagram of an apparatus according to an embodiment of the present invention.

FIG. 7 shows a further, more detailed block diagram of an apparatus 500 according to an embodiment of the present invention, which is based on FIG. 6*a*. Therefore, reference is made to the description of FIG. 6*a*.

As the previous discussion of spectral information and representation 560 in FIG. 6*b* has shown, it might be advisable for embodiments according to the present invention to first analyze the frame grids in order to generate a new frame grid for the output frame 550. As a consequence, the processing unit 520 comprises an analyzer 640 to which the two input data streams 510-1, 510-2 are provided. The processing unit 520 further comprises a spectral mixer 650, to which the input data streams 510 or the outputs of the analyzer 640 are coupled. Moreover, the processing unit 520 also comprises a SBR-mixer 660, which is also coupled to the input data stream 510 or the output of the analyzer 640. The processing unit 520 further comprises an estimator 670, which is also coupled to the two input data streams 510 and/or the analyzer 640 to receive the analyzed data and/or the input data streams with the frames 540 comprised therein. Depending on the concrete implementation, the estimator 670 may be coupled to at least one of the spectral mixers 650, or the SBR-mixer 660 to provide at least one of them with an estimated SBR value or estimated spectral value for frequencies in the previously defined intermediate region between the maximum value of the cross-over frequencies involved and the minimum values thereof.

The SBR-mixer 660, as well as the spectral mixer 650, is coupled to a mixer 680 which generates and outputs the output data stream 530 comprising the output frame 550.

With respect to the mode of operation, the analyzer 640 is adapted to analyze the frames 540 to determine the frame grids comprised therein and to generate a new frame grid including, for instance, a cross-over frequency. While the spectral mixer 650 is adapted to mix in the spectral domain, the spectral values or spectral information of the frames 540 for frequencies or spectral components below the minimum of the cross-over frequencies involved, the SBR-mixer 660 is similarly adapted to mix the respective SBR-data in the SBR domain. The estimator 670 provides for the intermediate frequency region in between the previously mentioned maximum and minimum values thereof, any of the two mixers 650, 660, with appropriate data in the spectral or the SBR-domain to enable these mixers to also operate in this intermediate frequency domain, if needed. The mixer 680 then compiles the spectral and SBR-data received from the two mixers 650, 660 to form and generate the output frame 550.

Embodiments according to the present invention may, for instance, be employed in the frame work of conferencing systems, for instance, a tele/video conferencing system with more than two participants. Such conferencing systems may offer the advantage of a lesser complexity compared to a time-domain mixing, since time-frequency transformation steps and re-encoding steps may be omitted. Moreover, no further delay is caused by these components compared to mixing in the time-domain, due to the absence of the filter-bank delay.

However, embodiments according to the present invention may also be employed in more complex applications, comprising modules such as perceptual noise substitution (PNS), temporal noise shaping (TNS) and different modes of stereo coding. Such an embodiment will be described in more detail with reference to FIG. 8.

Figure 8:
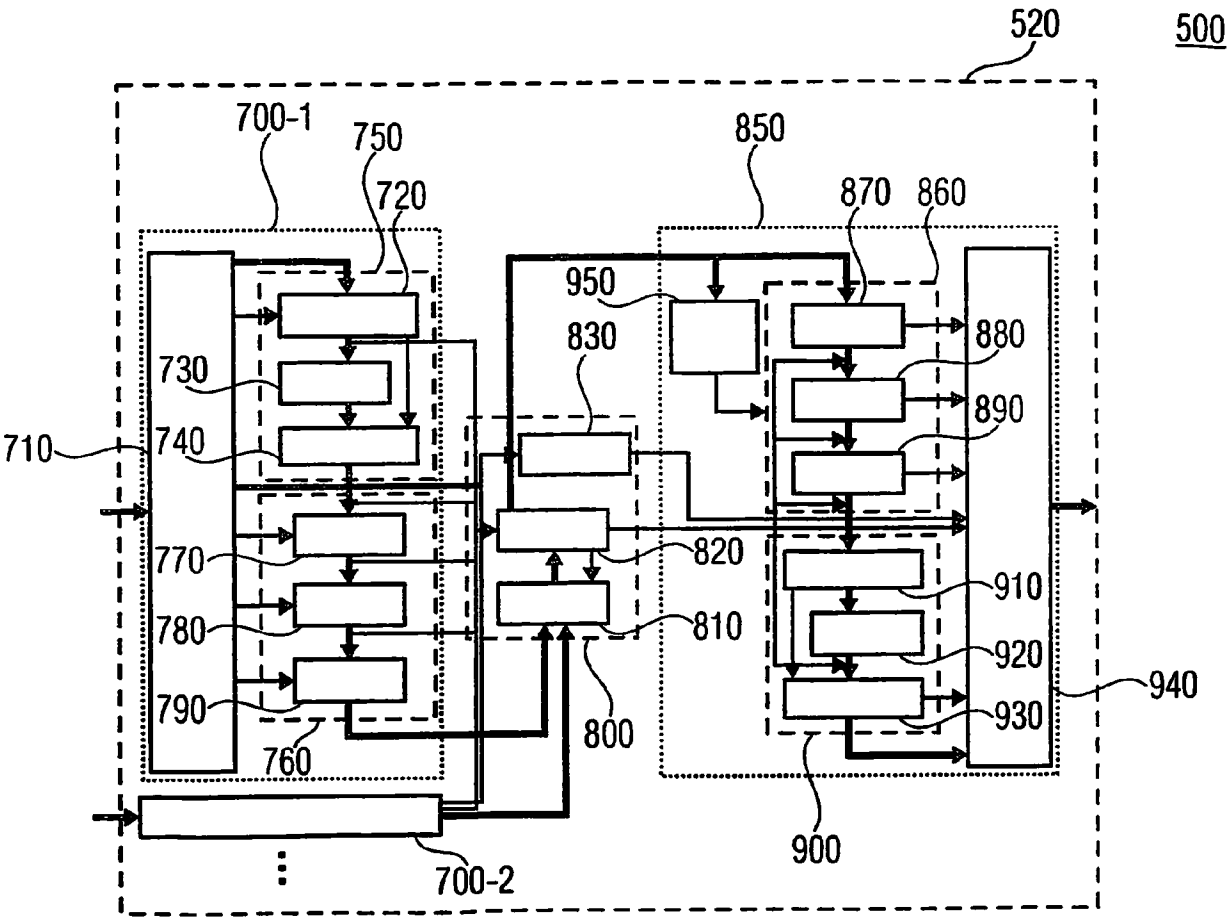
FIG. 8 shows a block diagram of an apparatus for mixing a plurality of input data streams according to a further embodiment of the present invention in the context of a conferencing system.

FIG. 8 shows a schematic block diagram of an apparatus 500 for mixing a plurality of input data streams comprising a processing unit 520. To be more precise, FIG. 8 shows a highly flexible apparatus 500 being capable of processing highly different audio signals encoded in input data streams (bit streams). Some of the components which will be described below are, therefore, optional components which do not need to be implemented under all circumstances, and in the framework of all embodiments according to the present invention.

The processing unit 520 comprises a bit stream decoder 700 for each of the input data streams or coded audio bit streams to be processed by the processing unit 520. For sake of simplicity only, FIG. 8 shows only two bit stream decoders 700-1, 700-2. Naturally, depending on the number of input data streams to be processed, a higher number of bit stream decoders 700, or a lower number, may be implemented, if for instance a bit stream decoder 700 is capable of sequentially processing more than one of the input data streams.

The bit stream decoder 700-1, as well as the other bit stream decoders 700-2, . . . each comprise a bit stream reader 710 which is adapted to receive and process the signals received, and to isolate and extract data comprised in the bit stream. For instance, the bit stream reader 710 may be adapted to synchronize the incoming data with an internal clock and may furthermore be adapted to separate the incoming bit stream into the appropriate frames.

The bit stream decoder 700 further comprises a Huffman decoder 720 coupled to the output of the bit stream reader 710 to receive the isolated data from the bit stream reader 710. An output of the Huffman decoder 720 is coupled to a de-quantizer 730, which is also referred to as an inverse quantizer. The de-quantizer 730 being coupled behind the Huffman decoder 720 is followed by a scaler 740. The Huffman decoder 720, the de-quantizer 730 and the scaler 740 form a first unit 750 at the output of which at least a part of the audio signal of the respective input data stream is available in the frequency domain or the frequency-related domain in which the encoder of the participant (not shown in FIG. 8) operates.

The bit stream decoder 700 further comprises a second unit 760 which is coupled data-wise after the first unit 750. The second unit 760 comprises a stereo decoder 770 (M/S module) behind which a PNS-decoder is coupled. The PNS-decoder 780 is followed data-wise by a TNS-decoder 790, which along with the PNS-decoder 780 at the stereo decoder 770 forms the second unit 760.

Apart from the described flow of audio data, the bit stream decoder 700 further comprises a plurality of connections between different modules concerning control data. To be more precise, the bit stream reader 710 is also coupled to the Huffman decoder 720 to receive appropriate control data. Moreover, the Huffman decoder 720 is directly coupled to the scaler 740 to transmit scaling information to the scaler 740. The stereo decoder 770, the PNS-decoder 780, and the TNS-decoder 790 are also each coupled to the bit stream reader 710 to receive appropriate control data.

The processing unit 520 further comprises a mixing unit 800 which in turn comprises a spectral mixer 810 which is input-wise coupled to the bit stream decoders 700. The spectral mixer 810 may, for instance, comprises one or more adders to perform the actual mixing in the frequency-domain. Moreover, the spectral mixer 810 may further comprise multipliers to allow an arbitrary linear combination of the spectral information provided by the bit stream decoders 700.

The mixing unit 800 further comprises an optimizing module 820 which is data-wise coupled to an output of the spectral mixer 810. The optimizing module 820 is, however, also coupled to the spectral mixer 810 to provide the spectral mixer 810 with control information. Data-wise, the optimizing module 820 represents an output of the mixing unit 800.

The mixing unit 800 further comprises a SBR-mixer 830 which is directly coupled to an output of the bit stream reader 710 of the different bit stream decoders 700. An output of the SBR-mixer 830 forms another output of the mixing unit 800.

The processing unit 520 further comprises a bit stream encoder 850 which is coupled to the mixing unit 800. The bit stream encoder 850 comprises a third unit 860 comprising a TNS-encoder 870, PNS-encoder 880, and a stereo encoder 890, which are coupled in series in the described order. The third unit 860, hence, forms an inverse unit of the first unit 750 of the bit stream decoder 700.

The bit stream encoder 850 further comprises a fourth unit 900 which comprises a scaler 910, a quantizer 920, and a Huffman coder 930 forming a series connection between an input of the fourth unit and an output thereof. The fourth unit 900, hence, forms an inverse module of the first unit 750. Accordingly, the scaler 910 is also directly coupled to the Huffman coder 930 to provide the Huffman coder 930 with respective control data.

The bit stream encoder 850 also comprises a bit stream writer 940 which is coupled to the output of the Huffman coder 930. Further, the bit stream writer 940 is also coupled to the TNS-encoder 870, the PNS-encoder 880, the stereo encoder 890, and the Huffman coder 930 to receive control data and information from these modules. An output of the bit stream writer 940 forms an output of the processing unit 520 and of the apparatus 500.

The bit stream encoder 850 also comprises a psychoacoustic module 950, which is also coupled to the output of the mixing unit 800. The bit stream encoder 850 is adapted to provide the modules of the third unit 860 with appropriate control information indicating, for instance, which may be employed to encode the audio signal output by the mixing unit 800 in the framework of the units of the third unit 860.

In principle, at the outputs of the second unit 760 up to the input of the third unit 860, a processing of the audio signal in the spectral domain, as defined by the encoder used on the sender side, is therefore possible. However, as indicated earlier, a complete decoding, de-quantization, de-scaling, and further processing steps may eventually not be essential if, for instance, spectral information of a frame of one of the input data streams is dominant. According to an embodiment of the present invention, at least a part of the spectral information of the respective spectral components, are then copied to the spectral component of the respective frame of the output data stream.

To allow such a processing, the apparatus 500 and the processing unit 520 comprises further signal lines for an optimized data exchange. To allow such a processing in the embodiment shown in FIG. 8, an output of the Huffman decoder 720, as well as outputs of the scaler 740, the stereo decoder 770, and the PNS-decoder 780 are, along with the respective components of other bit stream readers 710, coupled to the optimizing module 820 of the mixing unit 800 for a respective processing.

To facilitate, after a respective processing, a corresponding dataflow inside the bit stream encoder 850, corresponding data lines for an optimized dataflow are also implemented. To be more precise, an output of the optimizing module 820 is coupled to an input of the PNS-encoder 780, the stereo encoder 890, an input of the fourth unit 900 and the scaler 910, as well as an input into the Huffman coder 930. Moreover, the output of the optimizing module 820 is also directly coupled to the bit stream writer 940.

As indicated earlier, almost all modules as described above are optional modules, which do not need to be implemented in embodiments according to the present invention. For instance, in the case of the audio data streams comprising only a single channel, the stereo coding and decoding units 770, 890, may be omitted. Accordingly, in the case that no PNS-based signals are to be processed, the corresponding PNS-decoder and PNS-encoder 780, 880 may also be omitted. The TNS-modules 790, 870 may also be omitted in the case of the signal to be processed and the signal to be output is not based on TNS-data. Inside the first and fourth units 750, 900 the inverse quantizer 730, the scaler 740, the quantizer 920, as well as the scaler 910 may eventually also be omitted. Therefore, also these modules are to be considered optional components.

The Huffman decoder 720 and the Huffman encoder 930 may be implemented differently, using another algorithm, or completely omitted.

With respect to the mode of operation of the apparatus 500 along with the processing unit 520 comprised therein, an incoming input data stream is first read and separated into appropriate pieces of information by the bit stream reader 710. After Huffman decoding, the resulting spectral information may eventually be re-quantized by the de-quantizer 730 and scaled appropriately by the de-scaler 740.

Afterwards, depending on the control information comprised in the input data stream, the audio signal encoded in the input data stream may be decomposed into audio signals for two or more channels in the framework of the stereo decoder 770. If, for instance, the audio signal comprises a mid-channel (M) and a side-channel (S), the corresponding left-channel and right-channel data may be obtained by adding and subtracting the mid- and side-channel data from one another. In many implementations, the mid-channel is proportional to the sum of the left-channel and the right-channel audio data, while the side-channel is proportional to a difference between the left-channel (L) and the right-channel (R). Depending on the implementation, the above-referenced channels may be added and/or subtracted taking a factor ½ into account to prevent clipping effects. Generally speaking, the different channels can processed by linear combinations to yield the corresponding channels.

In other words, after the stereo decoder 770, the audio data may, if appropriate, be decomposed into two individual channels. Naturally, also an inverse decoding may be performed by the stereo decoder 770. If, for instance, the audio signal as received by the bit stream reader 710 comprises a left- and a right-channel, the stereo decoder 770 may equally well calculate or determine appropriate mid- and side-channel data.

Depending on the implementation not only of the apparatus 500, but also depending on the implementation of the encoder of the participant providing the respective input data stream, the respective data stream may comprise PNS-parameters (PNS=perceptual noise substitution). PNS is based on the fact that the human ear is most likely not capable of distinguishing noise-like sounds in a limited frequency range or spectral component such as a band or an individual frequency, from a synthetically generated noise. PNS therefore substitutes the actual noise-like contribution of the audio signal with an energy value indicating a level of noise to be synthetically introduced into the respective spectral component and neglecting the actual audio signal. In other words, the PNS-decoder 780 may regenerate in one or more spectral components the actual noise-like audio signal contribution based on a PNS parameter comprised in the input data stream.

In terms of the TNS-decoder 790 and the TNS-encoder 870, respective audio signals might have to be retransformed into an unmodified version with respect to a TNS-module operating on the sender side. Temporal noise shaping (TNS) is a means to reduce pre-echo artifacts caused by quantization noise, which may be present in the case of a transient-like signal in a frame of the audio signal. To counteract this transient, at least one adaptive prediction filter is applied to the spectral information starting from the low side of the spectrum, the high side of the spectrum, or both sides of the spectrum. The lengths of the prediction filters may be adapted as well as the frequency ranges to which the respective filters are applied.

In other words, the operation of a TNS-module is based on computing one or more adaptive IIR-filters (IIR=infinite impulse response) and by encoding and transmitting an error signal describing the difference between the predicted and actual audio signal along with the filter coefficients of the prediction filters. As a consequence, it may be possible to increase the audio quality while maintaining the bitrate of the transmitter data stream by coping with the transient-like signals by applying a prediction filter in the frequency domain to reduce the amplitude of the remaining error signal, which might then be encoded using less quantization steps as compared to directly encoding the transient-like audio signal with a similar quantization noise.

In terms of a TNS-application, it may be advisable under some circumstances to employ the function of the TNS-decoder 760 to decode the TNS-part of the input data stream to arrive at a "pure" representation in the spectral domain determined by the codec used. This application of the functionality of the TNS-decoders 790 may be useful if an estimation of the psychoacoustic model (e.g. applied in the psychoacoustic module 950) cannot already be estimated based on the filter coefficients of the prediction filters comprised in the TNS-parameters. This may especially be important in the case when at least one input data stream uses TNS, while another does not.

When the processing unit determines, based on the comparison of the frames of input data streams that the spectral information from a frame of an input data stream using TNS are to be used, the TNS-parameters may be used for the frame of output data. If, for instance for incompatibility reasons, the recipient of the output data stream is not capable of decoding TNS data, it might be useful not to copy the respective spectral data of the error signal and the further TNS parameters, but to process the reconstructed data from the TNS-related data to obtain the information in the spectral domain, and not to use the TNS encoder 870. This once again illustrates that parts of the components or modules shown in FIG. 8 do not need to be implemented in different embodiments according to the present invention.

In the case of at least one audio input stream comparing PNS data, a similar strategy may be applied. If in the comparison of the frames for a spectral component of the input data streams reveal that one input data stream is in terms of its present frame and the respective spectral component or the spectral components dominating, the respective PNS-parameters (i.e. the respective energy values) may also be copied directly to the respective spectral component of the output frame. If, however, the recipient is not capable of accepting the PNS-parameters, the spectral information may be reconstructed from the PNS-parameter for the respective spectral components by generating noise with the appropriate energy level as indicated by the respective energy value. Then, the noise data may accordingly be processed in the spectral domain.

As outlined before, the transmitted data also comprise SBR data, which are then processed by the SBR mixer 830 performing the previously described functionality.

Since SBR allows for two coding stereo channels, coding the left-channel and the right-channel separately, as well as coding same in terms of a coupling channel (C), according to an embodiment of the present invention, processing the respective SBR-parameters or at least parts thereof, may comprise copying the C elements of the SBR parameters to both, the left and right elements of the SBR parameter to be determined and transmitted, or vice-versa.

Moreover, since in different embodiments according to an embodiment of the present invention input data streams may comprise both, mono and stereo audio signals comprising one and two individual channels, respectively, a mono to stereo upmix or a stereo to mono downmix may additionally be performed in the framework of processing the frames of the input data streams and generating the output frame of the output data stream.

As the preceding description has shown, in terms of TNS-parameters it may be advisable to process the respective TNS-parameters along with the spectral information of the whole frame from the dominating input data stream to the output data stream to prevent a re-quantization.

In case of PNS-based spectral information, processing individual energy values without decoding the underlying spectral components may be viable way. In addition, in this case by processing only the respective PNS-parameter from a dominating spectral component of the frames of the pluralities of input data streams to the corresponding spectral component of the output frame of the output data stream occurs without introducing additional quantization noise.

As outlined before, an embodiment according to the present invention may also comprise simply copying a spectral information concerning a spectral component after comparing the frames of the plurality of input data streams and after determining, based on the comparison, for a spectral component of an output frame of the output data stream exactly one data stream to be the source of the spectral information.

The replacement algorithm performed in the framework of the psychoacoustic module 950 examines each of the spectral information concerning the underlying spectral components (e.g. frequency bands) of the resulting signal to identify spectral components with only a single active component. For these bands, the quantized values of the respective input data stream of input bit stream may be copied from the encoder without re-encoding or re-quantizing the respective spectral data for the specific spectral component. Under some circumstances all quantized data may be taken from a single active input signal to form the output bit stream or output data stream so that—in terms of the apparatus 500—a lossless coding of the input data stream is achievable.

Furthermore, it may become possible to omit processing steps such as the psychoacoustic analysis inside the encoder. This allows shortening the encoding process and, thereby, reducing the computational complexity since, in principle, only copying of data from one bit stream into another bit stream have to be performed under the certain circumstances.

For instance, in the case of PNS, a replacement can be carried out since noise factors of the PNS-coded band may be copied from one of the output data streams to the output data stream. Replacing individual spectral components with appropriate PNS-parameters is possible, since the PNS-parameters are spectral component-specific, or in other words, to a very good approximation independent from one another.

However, it may occur that a two aggressive application of the described algorithm may yield a degraded listening experience or an undesired reduction in quality. It may, hence, be advisable to limit replacement to individual frames, rather than spectral information, concerning individual spectral components. In such a mode of operation the irrelevance estimation or irrelevance determination, as well as replacement analysis may be carried out unchanged. However, a replacement may, in this mode of operation, only be carried out when all or at least a significant number of spectral components within the active frame are replaceable.

Although this might lead to a lesser number of replacements, an inner strength of the spectral information may in some situations be improved leading to an even slightly improved quality.

Turning back to SBR-mixing according to an embodiment of the present invention, leaving additional and optional components of the apparatus 500 shown in FIG. 8 out, the operating principles of SBR and mixing of SBR data will now be described in more detail.

As outlined before, the SBR-tool uses a QMF (Quadrature Mirror Filterbank) which represents a linear transformation. As a consequence, it is not only possible to process the spectral data 610 (cf. FIG. 6*b*) directly in the spectral domain, but also to process the energy values associated with each of the time/frequency regions 630 in the upper part 590 of the spectrum (cf. FIG. 6*b*). However, as indicated before, it might be advisable, and in some cases even essential, to first adjust the time/frequency grids involved prior to mixing.

Although, in principle it is possible to generate a completely new time/frequency grid, in the following, a situation will be described in which a time/frequency grid occurring in one source will be used as the time/frequency grid of the output frame 550. The decision which of the time/frequency grids may be used may for instance be based on a psychoacoustic consideration. For instance, when one of the grids comprises transient, it might be advisable to use a time/frequency grid comprising this transient or being compatible with this transient, since due to masking effects of the human auditory system, audible artifacts may eventually be introduced when deviating from this specific grid. In case, for instance, two or more frames with transients are to be processed by the apparatus 500 according to an embodiment of the present invention, it may be advisable to choose the time/frequency grid compatible with the earliest of these transients. Once again, due to masking effects, the choice for the grid containing the earlier attack may be, based on psychoacoustic considerations, an advantageous choice.

However, it should be pointed out that even under these circumstances, other time/frequency grids may also be calculated, or a different one may be chosen.

When mixing the SBR-frame grids, it is therefore in some cases advisable to analyze and determine the presence and position of one or more transients comprised in the frames 540. Additionally, or alternatively, this may also be achieved by evaluating the frame grids of the SBR-data of a respective frame 540 and verifying if the frame grids themselves are compatible with, or indicate the presence of a respective transient. For instance, the use of the LD_TRAN frame class, in the case of the AAC ELD codec, may indicate that a transient is present. Since this class also comprises the TRANSPOSE variable, also the position of the transient in terms of the time slots are known to the analyzer 640, as shown in FIG. 7.

However, since the other SBR-frame class FIXFIX may be used, different constellations may occur when generating the time/frequency gird of the output frame 550.

For instance, frames without transients, or with equal transient positions may occur. If the frames do not comprise transients, it may even be possible to use an envelope structure with a single envelope only expanding the whole frame. Also in the case that the number of envelopes is identical, the basic frame structure may be copied. In case the number of envelopes comprised in one frame is an integer number of that of the other frame, the finer envelope distribution may also be used.

Similarly, when all the frames 540 comprise transients at the same position, the time/frequency grid may be copied from either of the two grids.

When mixing frames without transients with a single envelope and a frame with a transient, the frame structure of the transient comprising frame may be copied. In this case, it may be safely assumed that no new transient will result when mixing the respective data. It is most likely that only the transient already present might be amplified or dampened.

In case frames with different transient positions are involved, each of the frames comprises a transient at different positions with respect to the underlying time slots. In this case, a suitable distribution based on the transient positions is desirable. In many situations, the position of the first transient is relevant since pre-echo effects and other problems will most probably be masked by the after-effects of the first transient. It might be suitable in this situation to adapt the frame grid accordingly to the position of the first transient.

After determining the distribution of envelopes with respect to the frames, the frequency resolution of the individual envelopes may be determined. As a resolution of the new envelope typically the highest resolution of the input envelopes will be used. If, for instance, the resolution of one of the analyzed envelopes is high, the output frame also comprises an envelope with a high resolution in terms of its frequency.

Figure 9B:
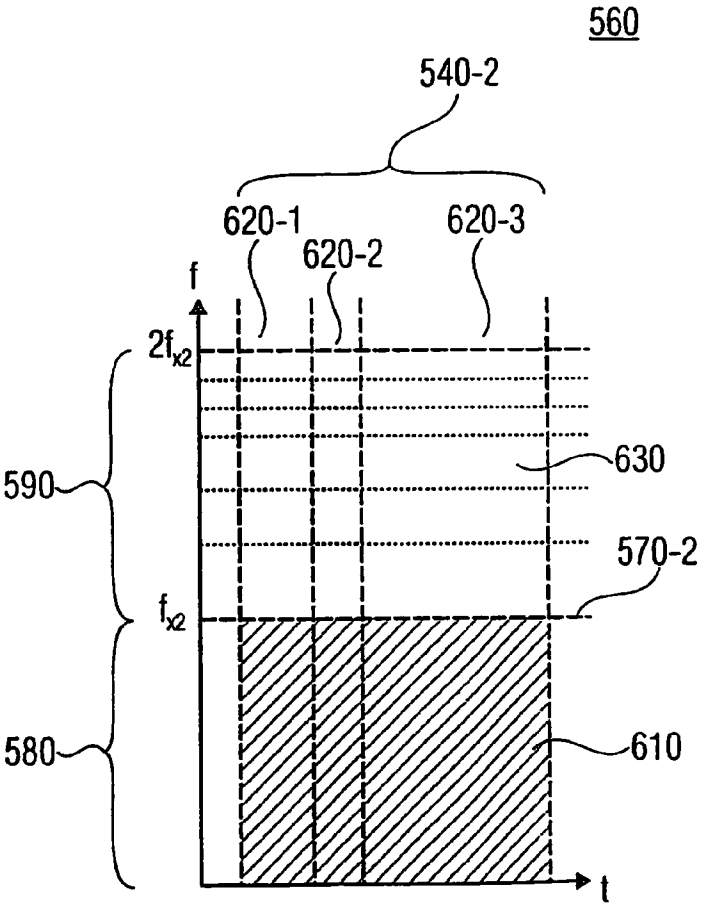
FIGS. 9*a* and 9*b* show a first frame and a second frame of a first and second input data stream as provided to an apparatus according to an embodiment of the present invention, respectively.
Figure 9A:
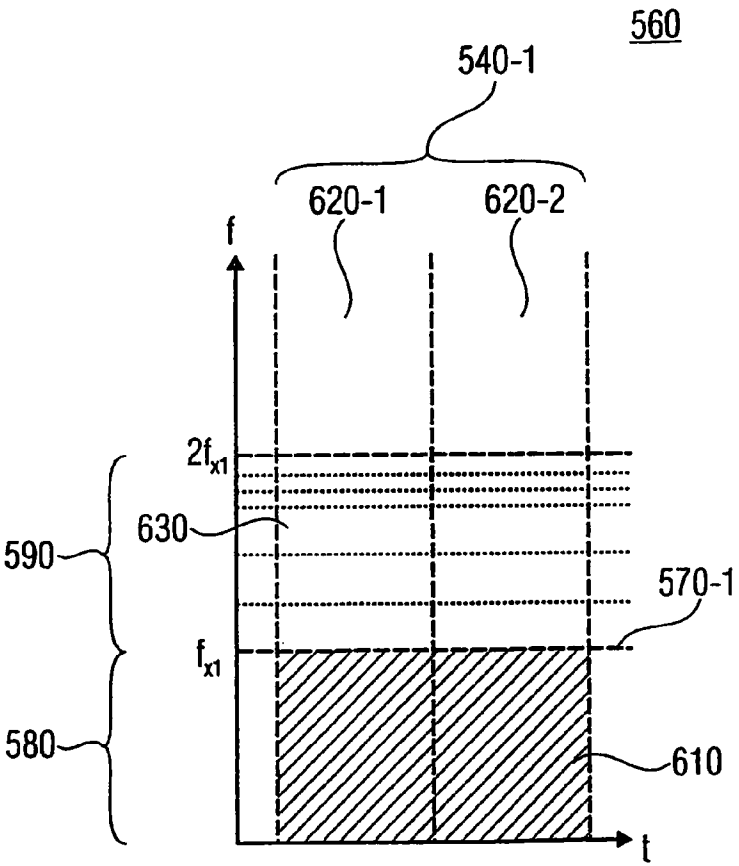

To illustrate this situation in more detail, especially in the case that the input frames 540-1, 540-2 of the two input data streams 510-1, 510-2 comprises different cross-over frequencies, FIG. 9*a* and FIG. 9*b* illustrate respective representations as shown in FIG. 6*a* for the two input frames 510-1, 540-2, respectively. Due to the very detailed description of FIG. 6*b*, the description of FIGS. 9*a* and 9*b* may here be abbreviated. Moreover, the frame 540-1 as shown in FIG. 9*a* is identical to that shown in FIG. 6*b*. It comprises, as previously described, two equally long envelopes 620-1, 620-2, with a plurality of time/frequency regions 630 above the cross-over frequency 570.

The second frame 540-2 as schematically shown in FIG. 9*b*, with respect to a few aspects differs from the frame shown in FIG. 9*a*. Apart from the fact that the frame grid comprises three envelopes 620-1, 620-2, and 620-3, which are not equally long, also the frequency resolution with respect to the time/frequency region 630 and the cross-over frequency 570 differs from that shown in FIG. 9*a*. In the example shown in FIG. 9*b*, the cross-over frequency 570 is larger than that of frame 540-1 of FIG. 9*a*. As a consequence, an upper part of the spectrum 590 is accordingly larger than that of frame 540-1 shown in FIG. 9*a*.

The fact that, based on an assumption that a AAC ELD codec has provided the frames 540 as shown in FIGS. 9*a* and 9*b*, the frame grid of frame 540-2 comprises three not equally long envelopes 620 leads to the conclusion that the second of the three envelopes 620 comprises a transient. Accordingly, the frame grid of the second frame 540-2 is, at least with respect to its distribution over time, the resolution to be chosen for the output frame 550.

Figure 9D:
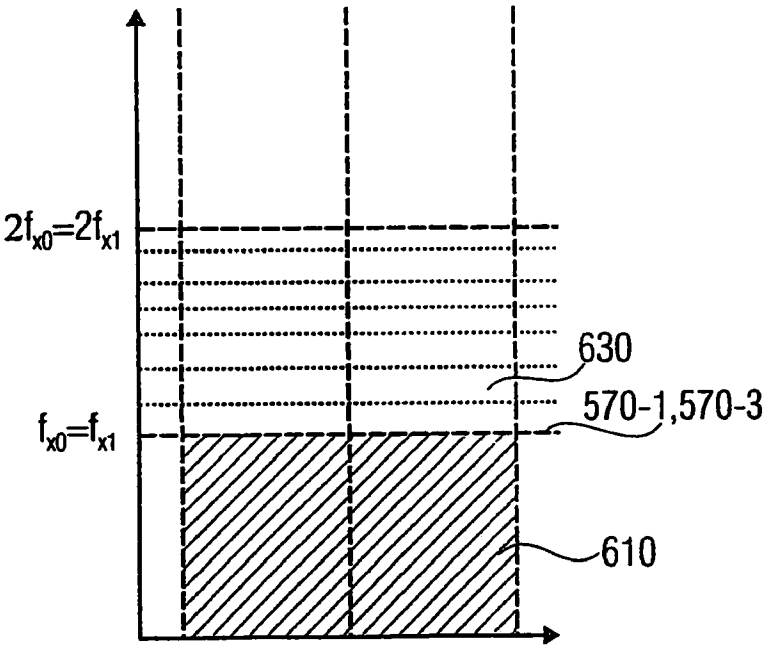
FIG. 9*d* shows an output frame as generated by an apparatus according to an embodiment of the present invention with an output cross-over frequency being the smaller of the two cross-over frequencies of the input frames.
Figure 9C:
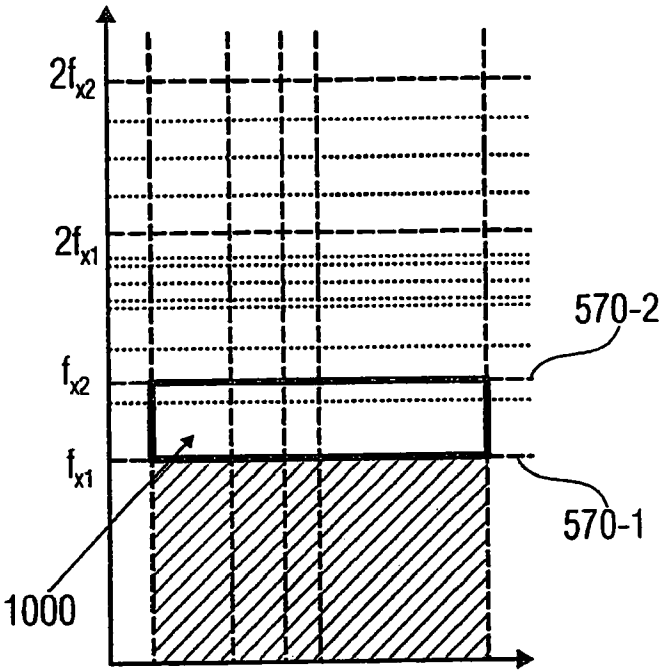
FIG. 9*c* shows an overlay situation of the input frames shown in FIGS. 9*a* and 9*b;*

However, as FIG. 9*c* shows, an additional challenge arises from the fact that different cross-over frequencies 570 are employed here. To be more specific, FIG. 9*c* shows an overlay situation in which the two frames 540-1, 540-2, in terms of their spectral information representations 560, have been shown together, By only considering the cross-over frequencies 570-1 of the first frame 540, as shown in FIG. 9*a* (cross-over frequency $f_{x1}$) and the higher cross-over frequency 570-2 of the second frame 540-2 as shown in FIG. 9*b* (cross-over frequency $f_{x2}$), an intermediate frequency range 1000 for which only SBR-data from the first frame 540-1 and for which only spectral data 610 from the second frame 540-1 are available. In other words, for spectral components of frequencies inside the intermediate frequency range 1000, the mixing procedure relies on estimated SBR values or estimated spectral data, as provided by the estimator 670 shown in FIG. 7.

In the situation depicted in FIG. 9*c*, the intermediate frequency range 1000, enclosed in terms of the frequency by the two cross-over frequencies 570-1, 570-2 represents the frequency range in which the estimator 670 and the processing unit 520 operate. In this frequency range 1000, SBR data are available only from the first frame 540-1, while from the second frame 540-2 in that frequency range only spectral information or spectral values are available. As a consequence, depending on whether a frequency or spectral component of the intermediate frequency range 1000 is above or below the output cross-over frequency, either a SBR value or a spectral value is to be evaluated prior to mixing the estimated value with the original value from one of the frames 540-1, 540-2 in the SBR domain are in the spectral domain.

FIG. 9*d* illustrates the situation in which the cross-over frequency of the output frame is equal to the lower of the two cross-over frequencies 570-1, 570-2. As a consequence, the output cross-over frequency 570-3 ($f_{xo}$) is equal to the first cross-over frequency 570-1 ($f_{x1}$), which also limits the upper part of the encoded spectrum to be twice the cross-over frequencies just mentioned.

By copying or redetermining the frequency resolution of the time/frequency grid based on the previously determined time resolution or envelope distribution thereof, the output SBR data are determined in the intermediate frequency range 1000 (cf. FIG. 9*c*) by estimating from the spectral data 610 of the second frame 540-2 for these frequencies corresponding SBR-data.

This estimation may be carried out based on the spectral data 610 of the second frame 540-2 in that frequency range taking into account SBR data for frequencies above the second cross-over frequency 570-2. This is based on the assumption that in terms of the time resolution or envelope distribution frequencies around the second cross-over frequency 570-2 are most probably equivalently influenced. Therefore, the estimation of the SBR data in the intermediate frequency range 1000 can be accomplished, for instance, by calculating on the finest time and frequency resolution described by SBR data the respective energy values based on the spectral information for each spectral component and by attenuating or amplifying each based on the time development of the amplitude as indicated by the envelopes of the SBR data of the second frame 540-2.

Afterwards, by applying a smoothing filter or another filtering step, the estimated energy values are mapped onto the time/frequency regions 630 of the time/frequency grid determined for the output frame 550. The solution as illustrated in FIG. 9*d* may cover, for instance, be interesting for lower bit rates. The lowest SBR cross-over frequency of all the streams incoming will be used as the SBR cross-over frequency for the output frame and SBR energy values are estimated for the frequency region 1000 in the gap between the core coder (operating up to the cross-over frequency) and the SBR coder (operating above the cross-over frequency) from the spectral information or spectral coefficients. The estimation may be carried out on the basis of a large variety of spectral information, for instance, derivable from MDCT (modified discrete cosine transformation) or from LDFB (low-delay filter bank) spectral coefficients. Additionally, smoothing filters may be applied to close the gap between the core coder and the SBR part.

It should also be noted that this solution may also be used to strip down a high bit rate stream, for instance, comprising 64 kbit/s, to a lower bit stream comprising, for instance, only 32 kbit/s. A situation in which such a solution might be advisable to be implemented is, for instance, to provide bit streams for participants with low data rate connections to the mixing unit, which are, for instance, established by modem dial in connections or the like.

Figure 9E:
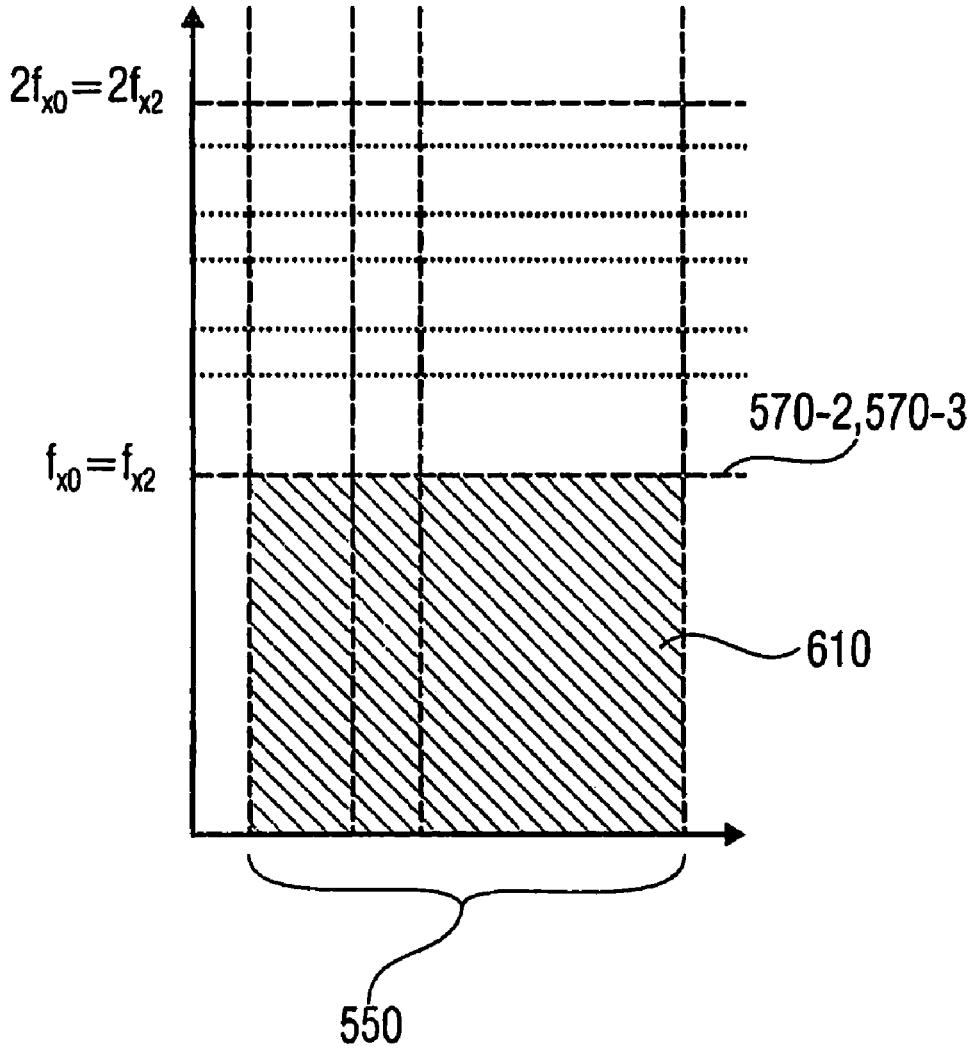
FIG. 9*e* shows an output frame as generated by an apparatus according to an embodiment of the present invention with an output cross-over frequency being the larger of the cross-over frequencies of the input frames.

Another case of different cross-over frequencies is illustrated in FIG. 9*e*.

FIG. 9*e* shows the case in which the higher of the two cross-over frequencies 570-1, 570-2 is used as the output cross-over frequency 570-3. Hence, the output frame 550 comprises up to the output cross-over frequency spectral information 610 and above the output cross-over frequency corresponding SBR data up to a frequency of typically twice the cross-over frequency 570-3. This situation, however, raises the question on how to re-establish the spectral data in the intermediate frequency range 1000 (cf. FIG. 9*c*). After determining the time resolution or envelope distribution of the time/frequency grid and after copying or determining at least partially the frequency resolution of the time/frequency grid for frequencies above the output cross-over frequency 570-3, based on the SBR data of the first frame 540-1 in the intermediate frequency range 1000 spectral data are to be estimated by the processing unit 520 and the estimator 670. This may be achieved by partially reconstructing the spectral information based on the SBR data for that frequency range 1000 of the first frame 540-1 taking, optionally, into account although some or all of the spectral information 610 below the first cross-over frequency 570-1 (cf. FIG. 9*a*). In other words, estimating the missing spectral information may be achieved by spectrally replicating the spectral information from the SBR data and the corresponding spectral information of the lower part 580 of the spectrum by applying the reconstruction algorithm of the SBR decoder at least partially to frequencies of the intermediate frequency range 1000.

After estimating spectral information of the intermediate frequency range by, for instance, applying a partial SBR decoding or reconstruction into the frequency domain, the resulting estimated spectral information may be directly mixed with the spectral information of the second frame 540-2 in the spectral domain by, for instance, applying a linear combination.

The reconstruction or replication of spectral information for frequencies or special components above the cross-over frequency is also referred to its inverse filtering. In this context it should be noted that also additional harmonics and additional noise energy values may be taken into consideration when estimating the respective spectral information for frequencies or components in the intermediate frequency range 1000.

This solution may be interesting, for instance, for participants being connected to the apparatus 500 or a mixing unit having higher bit rates available at the disposal. A patch or copy algorithm may be applied to the spectral information of the spectral domain, for instance, to the MDCT or LDFB spectral coefficients, to copy these from the lower band to higher bands to close the gap between the core coder and the SBR part, which are separated by the respective cross-over frequency. These copy coefficients are attenuated according to the energy parameters stored in the SBR payload.

In both scenarios as described in FIGS. 9*d* and 9*e*, spectral information below the lowest cross-over frequencies may be processed in the spectral domain directly, while SBR data being above the highest cross-over frequency may be processed directly in the SBR domain. For very higher frequencies above the lowest of the highest frequencies as described by the SBR data, typically above twice the minimum value of the cross-over frequencies involved, depending on the cross-over frequency of the output frame 550 different approaches may be applied. In principle, when using the highest of the cross-over frequencies involved as the output cross-over frequency 570-3 as illustrated in FIG. 9*e*, the SBR data for the highest frequency are mainly based on the SBR data of the second frame 540-2 only. As a further option, these values may be attenuated by a normalization factor or damping factor applied in the framework of linearly combining the SBR energy values for the frequencies below that cross-over frequency. In the situation as illustrated in FIG. 9*d*, when the lowest of the available cross-over frequencies is utilized as the output cross-over frequency, the respective SBR data of the second frame 540-2 may be disregarded.

Naturally, it should be noted that embodiments according to the present invention are, by far, not limited to only two input data streams that can easily be extended to a plurality of input data streams comprising more than two input data streams. In such a case, the described approaches can easily be applied to different input data streams depending on the actual cross-over frequency used in view of that input data stream. When, for instance, the cross-over frequency of this input data stream are of a frame comprised in that input data stream is higher than the output cross-over frequency of the output frame 550, the algorithms as described in context with FIG. 9*d* may be applied. On the contrary, when the corresponding cross-over frequency is lower, the algorithms and processes described in context with FIG. 9*e* may be applied to this input data stream. The actual mixing of the SBR data or the spectral information in the sense that more than two of the respective data are summed up.

Moreover, it should be noted that the output cross-over frequency 570-3 may be chosen arbitrarily. It is, by far, not essential to be identical to any of the cross-over frequencies of the input data streams. For instance, in the situation as described in context with FIGS. 9*d* and 9*e*, the cross-over frequency could also lie in between, below or above both cross-over frequencies 570-1, 570-2 of the input data streams 510. In the case, the cross-over frequency of the output frame 550 may be chosen freely, it may be advisable to implement all of the above-described algorithms in terms of estimating spectral data as well as SBR data.

On the other hand, some embodiments according to the present invention may be implemented such that the lowest or the highest cross-over frequency is used. In such a case, it might not be essential to implement the full functionality as described above. For instance, in case the lowest cross-over frequency is employed, the estimator 670 typically need not be able to estimate spectral information, but only SBR data. Hence, the functionality of estimating spectral data may eventually be avoided here. On the contrary, in the case, an embodiment according to the present invention is implemented such that the highest output cross-over frequency is employed, the functionality of the estimator 670 of being able to estimate SBR data might not be essential and, hence, omissible.

Embodiments according to the present invention may further comprise multi-channel downmix or multi-channel upmix components, for instance, stereo downmix or stereo upmix components in the case that some participants may send stereo or other multi-channel streams and some mono streams only. In this case, a corresponding upmix or downmix in terms of the number of channels comprised in the input data streams may be advisable to implement. It may be advisable to process some of the streams by upmixing or downmixing to provide mixed bit streams matching the parameters of the incoming streams. This may mean that the participant who sends a mono stream may also want to receive a mono stream in return. As a consequence, stereo or other multi-channel audio data from other participants may have to be converted to a mono stream or the other way round.

Depending on implementational restrictions and other boundary conditions this may, for instance, be accomplished by implementing a plurality of apparatuses according to an embodiment of the present invention or to process all input data streams based on a single apparatus, wherein the incoming data streams are downmixed or upmixed prior to the processing by the apparatus and downmixed or upmixed after the processing to match the requirements of the participant's terminal.

SBR allows also two modes of coding stereo channels. One mode of operation treats the left and right channels (LR) separately, while a second mode of operation operates on a coupled channel (C). For mixing a LR-encoded and a C-encoded element, either the LR-encoded element has to be mapped to a C-element or the other way round. The actual decision, which coding method is to be used may be preset or may be made by taking conditions into account, such as energy consumption, computation and complexity and the like, or it may be based on a psycho acoustic estimation in terms of the relevance of a separate treatment.

As pointed out before, mixing the actual SBR energy-related data may be accomplished in the SBR domain by a linear combination of the respective energy values. This may be achieved according to equation $$E(n) = \sum_{k=1}^{N} a_k \cdot E_k \mid n), \tag{6}$$

wherein $a_k$ is a weighting factor, $E_k(n)$ is the energy value of input data stream k, corresponding to a position in the time/frequency grid indicated by n. E(n) is the corresponding SBR energy value corresponding to the same index n. N is the number of input data streams and, in the example shown in FIGS. 9*a* and 9*e* equal to 2.

The coefficients $a_k$ may be used to perform a normalization as well as a weighting with respect to each time/frequency region 630 of the output frame 550 and the corresponding time/frequency regions 630 of the respective input frame 450 overlap. For instance, in case the two time/frequency regions 630 of the output frame 550 and the respective input frame 540 having an overlap with respect to each other to an extend of 50% in the sense that 50% of the time/frequency region 630 under consideration of the output frame 550 is made up by the corresponding time/frequency region 630 of the input frame 540, the value of 0.5 (=50%) may be multiplied with an overall gain factor indicating the relevance of the respective audio input stream and the input frame 540 comprised therein.

To put it in more general terms, each of the coefficients $a_k$ may be defined according to $$a_k = \sum_{i=1}^{M} r_{ik} \cdot g, \tag{7}$$

wherein $r_{ik}$ is the value indicating the overlap region of the two time/frequency regions 6301 and k of the input frame 540 and the output frame 550, respectively. M is the number of all time/frequency regions 630 of the input frame 540 and g a global normalization factor, which may, for instance, be equal to 1/N to prevent the outcome of the mixing process to overshoot or to undershoot an allowable range of values. The coefficients $r_{ik}$ may be in the range between 0 and 1, wherein 0 indicates that the two time/frequency regions 630 do not overlap at all and a value of 1 indicates that the time/frequency region 630 of the input frame 540 is completely comprised in the respective time/frequency region 630 of the output frame 550.

However, it may also occur that frame grids of the input frames 540 are equal. In this case, the frame grids may be copied from one of the input frames 540 to the output frame 550. Accordingly, mixing the relevant SBR energy values can be performed very easily. The corresponding frequency values may be added in this case similar to mixing corresponding spectral information (e.g. MDCT values) by adding and normalizing the output values.

However, since the number of the time/frequency regions 630 in terms of the frequency may change depending on the resolution of the respective envelope, it may be advisable to implement a mapping of a low-envelope to a high-envelope and vice versa.

Figure 10:
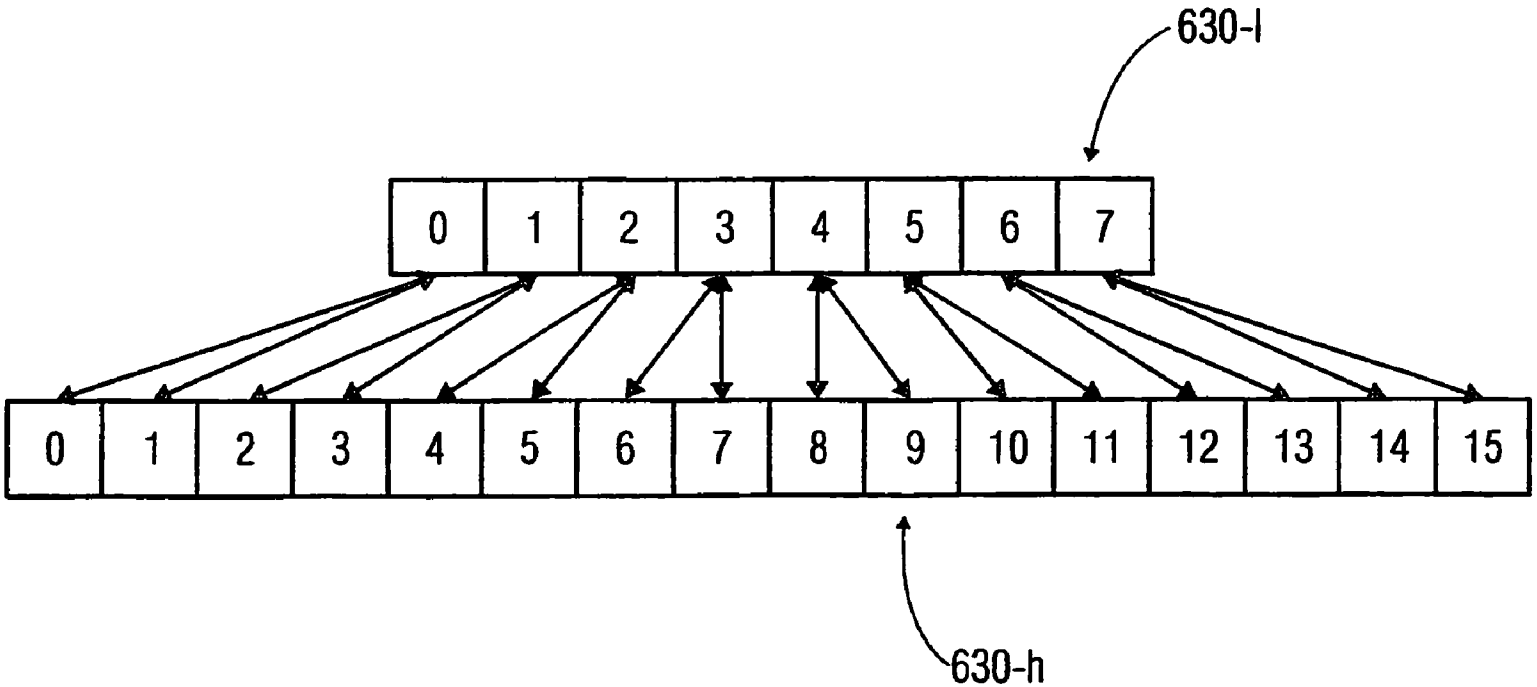
FIG. 10 illustrates matching low and high frequency grid resolutions.

FIG. 10 illustrates this for the example of eight time/frequency regions 630-*l* and a high-envelope comprising 16 corresponding time/frequency regions 630-*h*. As outlined before, a low-resolved envelope typically comprises only half the number of frequency data when compared to a highly resolved envelope, a simple matching can be established as illustrated in FIG. 10. When mapping the low-resolved envelope to a high-resolved envelope, each of the time/frequency region 630-*l* of the low-resolved envelope are mapped to two corresponding time/frequency regions 630-*h* of a highly-resolved envelope.

Depending on a concrete situation, for instance, in terms of normalizing, employing an additional factor of 0.5 may be advisable to prevent an overshooting of the mixed SBR energy values. In case the mapping is done the other way round, two neighboring time/frequency regions 630-*h* may be averaged by determining the arithmetic mean value to obtain one time/frequency region 630-*l* of a low-resolved envelope.

In other words, in the first situation with respect to equation (7) the factors $r_{ik}$ are either 0 or 1, while the factor g is equal to 0.5, in the second case the factor g may be set to 1 while the factor $r_{ik}$ may be either 0 or 0.5.

However, the factor g may have to be modified further by including an additional normalization factor taking into account the number of input data streams to be mixed. To mix the energy values of all the input signals, same are added and optionally multiplied with a normalization factor applied during the spectral mixing procedure. This additional normalization factor may eventually also have to be taken into account, when determining the factor g in equation (7). As a consequence, this may eventually ensure that the scale factors of the spectral coefficients of the base codec match the allowable range of values of the SBR energy values.

Embodiments according to the present invention may, naturally, differ with respect to their implementations. Although in the preceding embodiments, a Huffman decoding and encoding has been described as a single entropy encoding scheme, also other entropy encoding schemes may be used. Moreover, implementing an entropy encoder or an entropy decoder is by far not essential. Accordingly, although the description of the previous embodiments have focused mainly on the ACC-ELD codec, also other codecs may be used for providing the input data streams and for decoding the output data stream on the participant side. For instance, any codec being based on, for instance, a single window without block length switching may be employed.

As the preceding description of the embodiment shown in FIG. 8 has also shown, the modules described therein are not mandatory. For instance, an apparatus according to an embodiment of the present invention may simply be realized by operating on the spectral information of the frames.

It should further be noted that embodiments according to the present invention may be realized in very different ways. For instance, an apparatus 500 for mixing a plurality of input data streams and its processing unit 520 may be realized on the basis of discrete electrical and electronic devices such as resistors, transistors, inductors, and the like. Furthermore, embodiments according to the present invention may also be realized based on integrated circuits only, for instance in the form of SOCs (SOC=system on chip), processors such as CPUs (CPU=central processing unit), GPU (CPU=graphic processing unit), and other integrated circuits (IC) such as application specific integrated circuits (ASIC).

It should also be noted that electrical devices being part of the discrete implementation or being part of an integrated circuit may be used for different purposed and different functions throughout implementing an apparatus according to an embodiment of the present invention. Naturally, also a combination of circuits based on integrated circuits and discrete circuits may be used to implement an embodiment according to the present invention.

Based on a processor, embodiments according to the present invention may also be implemented based on a computer program, a software program, or a program which is executed on a processor.

In other words, depending on certain implementation requirements of embodiments of inventive methods, embodiments of the inventive methods may be implemented in hardware or in software. The implementation can be performed using a digital storage medium, in particular a disc, a CD or a DVD having electronically readable signals stored thereon which cooperate with a programmable computer or processor such that an embodiment of the inventive method is performed. Generally, an embodiment of the present invention is, therefore, a computer program product with a program code stored on a machine-readable carrier, the program code being operative to perform an embodiment of the inventive method when the computer program product runs on a computer or processor. In yet other words, embodiments of the inventive methods are, therefore, a computer program having a program code for performing at least one of the embodiments of the inventive methods, when the computer program runs on a computer or processor. A processor can be formed by a computer, a chip card, a smart card, an application-specific integrated circuit, a system on chip (SOC), or an integrated circuit (IC).

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. An apparatus for mixing a first frame of a first input data stream and a second frame of a second input data stream to acquire an output frame of an output data stream, wherein the first frame comprises first spectral data describing a lower part of a first spectrum of a first audio signal up to a first cross-over frequency and first spectral band replication data describing a higher part of the first spectrum starting from the first cross-over frequency, wherein the second frame comprises second spectral data describing a lower part of a second spectrum of a second audio signal up to a second cross-over frequency and second SBR-data describing a higher part of the second spectrum starting from the second cross-over frequency, wherein the first and second SBR-data describe the respective higher parts of the first and second spectrum by way of energy-related values in time/frequency grid resolutions and wherein the first cross-over frequency is different from the second cross-over frequency, the apparatus comprising:

a processing unit adapted to generate the output frame, the output frame comprising output spectral data describing a lower part of an output spectrum up to an output cross-over frequency and the output frame further comprising output SBR-data describing a higher part of the output spectrum above the output cross-over frequency by way of energy-related values in an output time/frequency grid resolution, wherein the processing unit is adapted such that the output spectral data corresponding to the frequencies below a minimum value of the first cross-over frequency, the second cross-over frequency and the output cross-over frequency is generated in a spectral domain based on the first and second spectral data;

wherein the processing unit is further adapted such that the output SBR-data corresponding to the frequencies above a maximum value of the first cross-over frequency, the second cross-over frequency and the output cross-over frequency is processed in a SBR-domain based on the first and second SBR-data; and wherein the processing unit is further adapted such that for a frequency region between the minimum value and the maximum value, at least one SBR-value from at least one of a first and second spectral data is estimated and a corresponding SBR-value of the output SBR-data is generated, based on at least the estimated SBR-value.

2. The apparatus according to claim 1, wherein the processing unit is adapted to estimate the at least one SBR value based on a spectral value corresponding of a frequency component corresponding to the SBR value to be estimated.

3. The apparatus according to claim 1, wherein the processing unit is adapted to determine the output cross-over frequency to be the first cross-over frequency or the second cross-over frequency.

4. The apparatus according to claim 1, wherein the processing unit is adapted to set the output cross-over frequency to the lower cross-over frequency of a first and second cross-over frequency, or to set the output cross-over frequency to the higher of the first and second cross-over frequencies.

5. The apparatus according to claim 1, wherein the processing unit is adapted to determine the output time/frequency grid resolution to be compatible with a transient position of a transient being indicated by the time/frequency grid resolution of the first or second frame.

6. The apparatus according to claim 5, wherein the processing unit is adapted to set the time/frequency grid resolution to be compatible with an earlier transient being indicated by the time/frequency grid resolutions of the first and second frames, when the time/frequency grid resolutions of the first and second frames indicate a presence of more than one transient.

7. The apparatus according to claim 1, wherein the processing unit is adapted to output spectral data or to output SBR-data based on a linear combination in the SBR frequency domain or in the SBR domain.

8. The apparatus according to claim 1, wherein the processing unit is adapted to generate the output SBR-data comprising sinusoid-related SBR-data based on a linear combination of sinusoid-related SBR-data of the first and second frames.

9. The apparatus according to claim 8, wherein the processing unit is adapted to comprise the sinusoid-related or noise-related SBR-data based on a psycho-acoustic estimation of a relevance of a respective SBR-data of the first and second frames.

10. The apparatus according to claim 1, wherein the processing unit is adapted to generate the output SBR-data comprising noise-related SBR-data based on a linear combination of noise-related SBR-data of the first and second frames.

11. The apparatus according to claim 1, wherein the processing unit is adapted to generate the output SBR-data based on a smoothing filtering.

12. The apparatus according to claim 1, wherein the apparatus is adapted to process a plurality of input data streams, the plurality of input data streams comprising more than two input data streams, wherein the plurality of input data streams comprises the first and second input data streams.

13. An apparatus for mixing a first frame of a first input data stream and a second frame of a second input data stream to acquire an output frame of an output data stream, wherein the first frame comprises first spectral data describing a lower part of a first spectrum of a first audio signal up to a first cross-over frequency and first spectral band replication data describing a higher part of the first spectrum starting from the first cross-over frequency, wherein the second frame comprises second spectral data describing a lower part of a second spectrum of a second audio signal up to a second cross-over frequency and second SBR-data describing a higher part of the second spectrum starting from the second cross-over frequency, wherein the first and second SBR-data describe the respective higher parts of the first and second spectrum by way of energy-related values in time/frequency grid resolutions and wherein the first cross-over frequency is different from the second cross-over frequency, the apparatus comprising:

a processing unit adapted to generate the output frame, the output frame comprising output spectral data describing a lower part of an output spectrum up to an output cross-over frequency and the output frame further comprising output SBR-data describing a higher part of the output spectrum above the output cross-over frequency by way of energy-related values in an output time/frequency grid resolution, wherein the processing unit is adapted such that the output spectral data corresponding to the frequencies below a minimum value of the first cross-over frequency, the second cross-over frequency and the output cross-over frequency is generated in a spectral domain based on the first and second spectral data;

wherein the processing unit is further adapted such that the output SBR-data corresponding to the frequencies above a maximum value of the first cross-over frequency, the second cross-over frequency and the output cross-over frequency is processed in a SBR-domain based on the first and second SBR-data; and wherein the apparatus is further adapted such that for a frequency region between the minimum value and the maximum value, at least one spectral value from at least one of the first and second frames is estimated based on the SBR-data of the respective frame, and a corresponding spectral value of the output spectral data is generated based on at least the estimated spectral value by processing same in the spectral domain.

14. The apparatus according to claim 13, wherein the processing unit is adapted to estimate the at least one spectral value based on reconstructing at least one spectral value for a spectral component based on the SBR-data and the spectral data of the lower part of the respective spectrum of the respective frame.

15. A method for mixing a first frame of a first input data stream and a second frame of a second input data stream to acquire an output frame of an output data stream, wherein the first frame comprises first spectral data describing a lower part of a spectrum of a first audio signal up to a first cross-over frequency and first spectral band replication data describing a higher part of the spectrums starting from the first cross-over frequency, wherein the second frame comprises second spectral data describing a lower part of a second spectrum of a second audio signal up to a second cross-over frequency and second SBR-data describing a higher part of a second spectrum starting from the second cross-over frequency, wherein the first and second SBR-data describes the respective higher parts of the respective spectra by way of energy-related values in time/frequency grid resolutions, and wherein the first cross-over frequency is different from the second cross-over frequency, comprising:

generating the output frame comprising output spectral data describing a lower part of an output spectrum up to an output cross-over frequency and the output frame further comprising output SBR-data describing a higher part of the output spectrum above the output cross-over frequency by way of energy related values in an output time/frequency grid resolution;

generating spectral data corresponding to frequencies below a minimum value of the first cross-over frequency, the second cross-over frequency and an output cross-over frequency in a spectral domain based on the first and second spectral data;

generating output SBR-data corresponding to frequencies above a maximum value of the first cross-over frequency, the second cross-over frequency and the output cross-over frequency in an SBR domain based on the first and second SBR-data; and estimating at least one SBR value from at least one of a first and second spectral data for a frequency in a frequency region between the minimum value and the maximum value and generating a corresponding SBR value for the output SBR-data, based on at least the estimated SBR-value; or estimating at least one spectral value from at least one of the first and second frames based on the SBR-data of the respective frame for a frequency in a frequency region between the minimum value and the maximum value and generating a spectral value of the output spectral data based on at least the estimated spectral value by processing same in the spectral domain.

16. A non-transitory storage medium having stored thereon a program for performing, when running on a processor, a method for mixing a first frame of a first input data stream and a second frame of a second frame of a second input data stream to acquire an output frame of an output data stream, wherein the first frame comprises first spectral data describing a lower part of a spectrum of a first audio signal up to a first cross-over frequency and first spectral band replication data describing a higher part of the spectrums starting from the first cross-over frequency, wherein the second frame comprises second spectral data describing a lower part of a second spectrum of a second audio signal up to a second cross-over frequency and second SBR-data describing a higher part of a second spectrum starting from the second cross-over frequency, wherein the first and second SBR-data describes the respective higher parts of the respective spectra by way of energy-related values in time/frequency grid resolutions, and wherein the first cross-over frequency is different from the second cross-over frequency, comprising:

generating the output frame comprising output spectral data describing a lower part of an output spectrum up to an output cross-over frequency and the output frame further comprising output SBR-data describing a higher part of the output spectrum above the output cross-over frequency by way of energy related values in an output time/frequency grid resolution;

generating spectral data corresponding to frequencies below a minimum value of the first cross-over frequency, the second cross-over frequency and an output cross-over frequency in a spectral domain based on the first and second spectral data;

generating output SBR-data corresponding to frequencies above a maximum value of the first cross-over frequency, the second cross-over frequency and the output cross-over frequency in an SBR domain based on the first and second SBR-data; and estimating at least one SBR value from at least one of a first and second spectral data for a frequency in a frequency region between the minimum value and the maximum value and generating a corresponding SBR value for the output SBR-data, based on at least the estimated SBR-value; or estimating at least one spectral value from at least one of the first and second frames based on the SBR-data of the respective frame for a frequency in a frequency region between the minimum value and the maximum value and generating a spectral value of the output spectral data based on at least the estimated spectral value by processing same in the spectral domain.

* * * * *